US007338270B2

(12) United States Patent
Mathews

(10) Patent No.: US 7,338,270 B2
(45) Date of Patent: Mar. 4, 2008

(54) GUIDE DEVICE FOR USE WITH FLAT BOX DEVICE IN APPLYING DRYWALL MASTIC

(76) Inventor: Steve Mathews, 20283 Emerald Ave., Port Charlotte, FL (US) 33952

( * ) Notice: Subject to any disclaimer, the term of this patent is extended or adjusted under 35 U.S.C. 154(b) by 92 days.

(21) Appl. No.: 11/418,015

(22) Filed: May 4, 2006

(65) Prior Publication Data

US 2007/0259064 A1 Nov. 8, 2007

(51) Int. Cl.
*B29C 59/02* (2006.01)

(52) U.S. Cl. ..... 425/87; 425/458; 15/235.3; 15/235.4; 401/203; 401/266

(58) Field of Classification Search ..... 425/87, 425/458; 15/235.3, 235.4, 235.7, 235.8; 401/9, 203, 266
See application file for complete search history.

(56) References Cited

U.S. PATENT DOCUMENTS

| | | | | |
|---|---|---|---|---|
| 2,630,703 | A | | 3/1953 | Sommers |
| 2,666,323 | A | | 1/1954 | Ames |
| 2,711,098 | A | | 6/1955 | Ames |
| 2,824,442 | A | | 2/1958 | Ames |
| 2,889,965 | A | | 6/1959 | Ames |
| 3,186,056 | A | | 6/1965 | Hoveland |
| 3,888,611 | A | | 6/1975 | Ames |
| 4,129,407 | A | * | 12/1978 | Golls et al. ..... 425/87 |
| 4,516,868 | A | * | 5/1985 | Molnar ..... 425/87 |
| 4,907,955 | A | | 3/1990 | Snipes |
| 5,069,610 | A | | 12/1991 | Milburn |
| 5,122,006 | A | * | 6/1992 | MacMillan ..... 425/458 |
| 5,814,351 | A | | 9/1998 | Mower |
| 6,877,923 | B2 | | 4/2005 | Grayden |

* cited by examiner

*Primary Examiner*—Yogendra N. Gupta
*Assistant Examiner*—Thu Khanh T. Nguyen
(74) *Attorney, Agent, or Firm*—Scott T. Griggs; Griggs Bergen LLP

(57) ABSTRACT

A guide device is adapted to be removably attached to a flat box device for use in applying mastic adjacent an outside corner or edge. The guide device includes a generally S-shaped guide bar, a bracket, and a spring. The bracket is adapted to attach to the flat box device. The guide bar is pivotably and slidably retained by the a first bracket portion. The spring is adapted to bias a first guide bar end of the guide bar away from the first bracket portion of the bracket. The guide bar extends across a width of the flat box device and the first guide bar end extends below the flat box device when the guide device is operably installed on the flat box device. The spring biases the guide bar in a lateral direction corresponding to the width of the flat box device when the guide device is operably installed on the flat box device.

20 Claims, 20 Drawing Sheets

GUIDE DEVICE FOR USE WITH FLAT BOX DEVICE IN APPLYING DRYWALL MASTIC

TECHNICAL FIELD

The present invention generally relates to applying drywall mastic with a flat box device. More particularly, the present invention relates to a guide device for use with a flat box device in applying drywall mastic at an outside corner or along an edge.

BACKGROUND

There are several ways that drywall mastic (a.k.a., drywall mud) is applied over tape joints in the tape-and-bedding industry. Some simply use spatula blades to apply the drywall mastic, but this method requires great skill and training. Others use flat box devices, which are much faster to use, provide more consistent results, and usually better results than using a spatula blade. Flat box devices have been in use for many years now. Some of the more prevalent flat box devices are the "Ames style" or Ames brand flat boxes. These are often preferred by construction professionals.

FIGS. 1 and 2 show a 7-inch-wide Ames flat box device 20. FIG. 1 is a bottom perspective view of the flat box device 20. As illustrated in FIG. 1, most flat box devices have a mastic application opening 22 extending along a lateral direction (across most of the width of the device 20) on a bottom side 24 of the flat box device 20. This mastic application opening 22 is where the mastic exits the interior of the flat box device 20 and is evenly spread upon a surface during application. One of ordinary skill in the art in the tape-and-bedding industry will likely be familiar with the components and operation of the flat box device 20. The "Ames style" flat box device 20 shown in FIGS. 1 and 2 is representative of most flat box devices existing and in use in the industry today.

FIG. 2 is a front view of the flat box device 20 of FIG. 1 showing the front side 26 of the flat box device 20. As is typical with most flat box devices, the flat box device 20 of FIG. 2 includes a spring biased adjustment for the application blade 28 with adjustment screws 30 and pressure selection cam 32. For most Ames or "Ames style" flat box devices 20, the placement of the adjustment screws 30 (see FIG. 2) and the spacing of the adjustment screws 30 is about the same (for same size flat box devices). The relevance of this point will be more apparent later in the description section below.

A typical flat box device, like the flat box device 20 shown in FIGS. 1 and 2 for example, is adapted to apply mastic over tape joints along a flat surface. Such flat box devices can be used at or immediately adjacent to an outside corner or edge of a surface. But using a typical flat box device at an outside corner or edge requires great precision in handling the flat box device to obtain mastic cover all the to the edge or corner, and without leaving large lumps or deposits of unwanted mastic over the edge or on the other side of the corner. Maneuvering and handling the flat box device to avoid or minimize unwanted deposits over the edge requires more focus and slower movements, which makes the job slower and more difficult to master. Hence, there is a need for providing a way to allow a flat box device to be used at an outside corner or edge quickly, accurately, and easily, while still providing a high quality application of mastic with little or no unwanted mastic deposits over the edge or on the other side of the corner.

There have been several attempts in the prior art to resolve this problem by adding guide members to the flat box device. However, many of these solutions in the prior art required modification of existing flat box devices (drilling holes, permanently attaching brackets, etc.) or resulted in a flat box device dedicated to being used on outside corners or edges only. The problem with these solutions is that there are already existing many flat box devices that do not need to be replaced, which still have much life left for their use. Many workers do not want to bother with difficult modifications to the device requiring precise drilling and special tools to attach guides to existing flat box devices. Also, most workers do not desire to buy, nor carry around to job sites, multiple flat box devices. They would prefer few devices to buy and carry. Thus, a great need exists to utilize the existing flat box devices while providing a way to guide the flat box device along outside corners or edges. Also, most workers do not want to spend large sums of money to obtain a separate flat box device just for outside corners. Hence, there is a further need to inexpensively adapt and utilize existing flat box devices for applying mastic at outside corners and edges, quickly and accurately without preventing the existing flat box devices to still be used on flat surfaces (away from edges). This is also a need for a way to provide a guide device that is fast and easy to install without requiring special tools or machine work and without altering the original functionality of the flat box devices.

SUMMARY OF THE INVENTION

The problems and needs outlined above may be addressed by embodiments of the present invention. In accordance with one aspect of the present invention, which will be summarized in this paragraph, a guide device adapted to be attached to a flat box device for use in applying drywall mastic with the flat box device, is provided. The guide device includes a generally S-shaped guide bar, a bracket, and a spring. The guide bar includes: a first bend at a first end portion; a first guide bar end extending from the first bend at the first end portion; a second bend at a second end portion; a second guide bar end extending from the second bend at the second end portion; and a central portion extending between the first bend and the second bend. The bracket is adapted to be attached to the flat box device. The guide bar is pivotably and slidably retained by the bracket. The bracket includes a first bracket portion extending at least partially about the guide bar along at least part of the central portion of the guide bar. The spring is adapted to bias the first guide bar end away from the first bracket portion of the bracket. The guide device may further include a spring stop portion extending from the guide bar, such that the spring biases the first guide bar end via the spring stop portion. The bracket may further include a generally hook-shaped portion adapted to retain the first guide bar end when the guide device is in a first guide configuration. The bracket may further include a channel portion adapted to retain the second guide bar end when the guide device is in a second guide configuration. The guide bar may include stainless steel material and at least part of the guide bar may have a solid round cross-section. The bracket may include stainless steel material and at least part of the bracket may be formed from sheet metal material. The spring may be a metal coil spring located about the guide bar along at least part of the central portion of the guide bar. The bracket may further include two elongated notches and one generally L-shaped slot, wherein the generally L-shaped slot is located between the two elongated notches. The guide bar extends across a width of the flat box device when the guide device is operably installed on the flat box device. The spring may bias the guide bar in a lateral direction corresponding to a width of the flat box device when the guide device is operably installed on the flat box device. The guide device may be adapted to be removably attached to the flat box device using existing hardware of the flat box device.

In accordance with another aspect of the present invention, which will be summarized in this paragraph, a guide device adapted to be attached to a flat box device for use in applying drywall mastic with the flat box device, is provided. The guide device includes a generally S-shaped guide bar, a bracket, and a spring. The bracket is adapted to be removable attached to the flat box device. The guide bar is pivotably and slidably retained by the bracket. The bracket includes a first bracket portion extending at least partially about the guide bar along at least part of a central portion of the guide bar. The spring is adapted to bias a first guide bar end of the guide bar away from the first bracket portion of the bracket. The guide bar extends across a width of the flat box device when the guide device is operably installed on the flat box device. The spring biases the guide bar in a lateral direction corresponding to the width of the flat box device when the guide device is operably installed on the flat box device. The spring may be a metal coil spring located about the guide bar along at least part of the central portion of the guide bar. The bracket may further include a channel portion adapted to retain a second guide bar end when the guide device is in a second guide configuration. The bracket may further include a generally hook-shaped portion adapted to retain the first guide bar end when the guide device is in a first guide configuration. The guide device may further include a spring stop portion extending from the guide bar, wherein the spring biases the first guide bar end via the spring stop portion. The bracket may further include two elongated notches and one generally L-shaped slot, wherein the generally L-shaped slot is located between the two elongated notches, and wherein the guide device is adapted to be removably attached to the flat box device using existing hardware of the flat box device.

In accordance with yet another aspect of the present invention, which will be summarized in this paragraph, a guide device for a flat box device, is provided. The flat box device is adapted for use in applying drywall mastic to a surface. The flat box device has an mastic application opening extending along a lateral direction on a bottom side of the flat box device. The guide device includes a guide bar member, a bracket, and a spring member. The guide bar member has a generally L-shaped portion. A first leg portion of the generally L-shaped portion of the guide bar member is adapted to extend along the lateral direction of the flat box device when the guide device is operably installed on the flat box device. A second leg portion of the generally L-shaped portion of the guide bar member is adapted to extend below the bottom side of the flat box device when the guide device is operably installed on the flat box device. The first leg portion of the guide bar member is pivotably and slidably retained by the bracket. The spring member provides a spring bias between the guide bar member and the bracket generally along the lateral direction of the flat box device when the guide device is operably installed on the flat box device. The guide bar member may be generally S-shaped, for example.

The foregoing has outlined rather broadly features of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures or processes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

The following is a brief description of the drawings, which illustrate exemplary embodiments of the present invention and in which.

DETAILED DESCRIPTION OF ILLUSTRATIVE EMBODIMENTS

Figure 1:
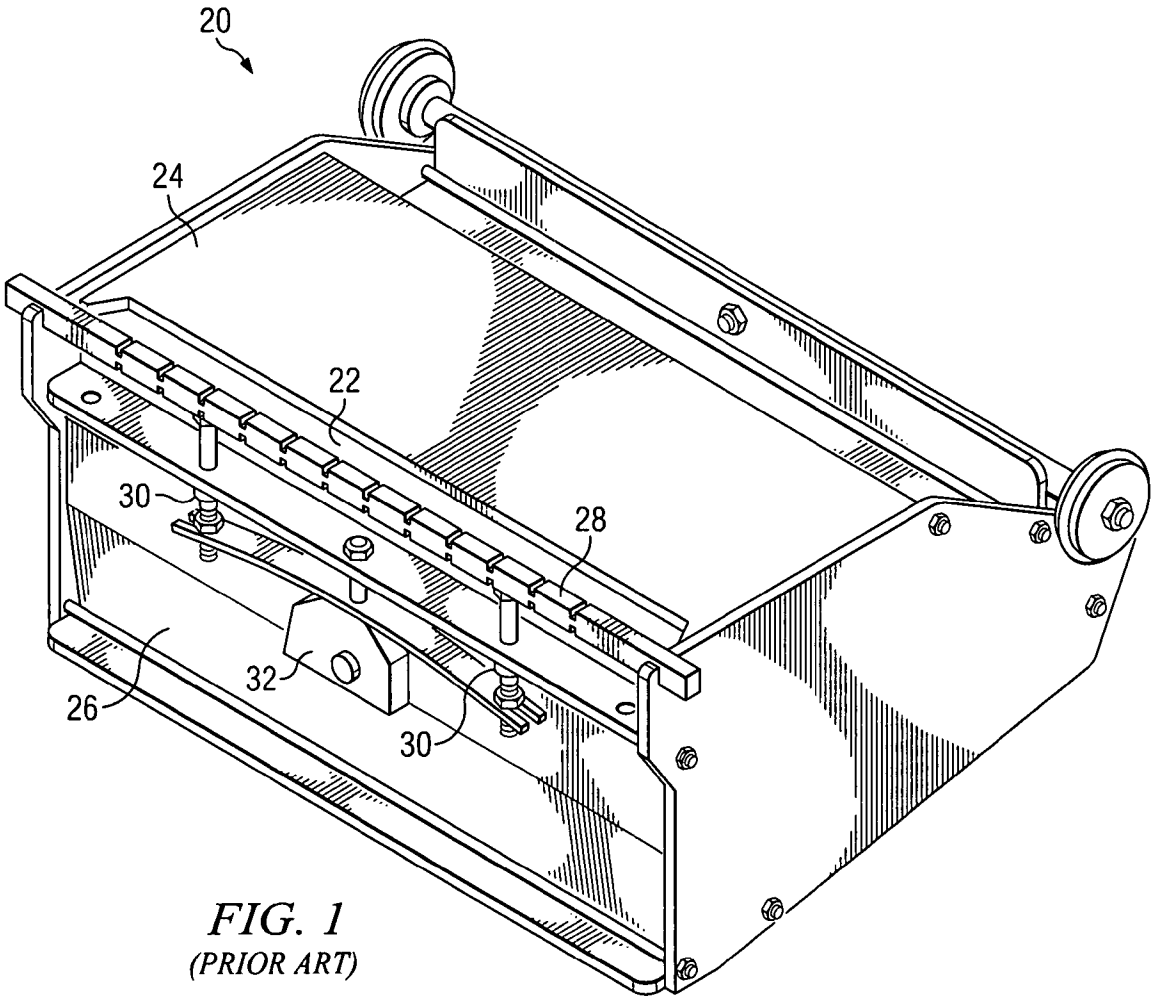
FIG. 1 (PRIOR ART)
FIG. 1 is a bottom perspective view of the conventional flat box device of the prior art.

Referring now to the drawings, wherein like reference numbers are used herein to designate like or similar elements throughout the various views, illustrative embodiments of the present invention are shown and described. The figures are not necessarily drawn to scale, and in some instances the drawings have been exaggerated and/or simplified in places for illustrative purposes only. One of ordinary skill in the art will appreciate the many possible applications and variations of the present invention based on the following illustrative embodiments of the present invention.

Generally, an embodiment of the present invention provides a guide device for an existing and/or later developed flat box device for use in applying drywall mastic at an outside corner or at an edge of a surface. The following description describes an illustrative and currently preferred embodiment the present invention. Although only one embodiment is shown, the present invention and its underlying concepts of invention are not limited to the preferred embodiment shown and described herein. This will be apparent to one of ordinary skill in the art upon reading this description, studying the drawings, and reading the claims.

As discussed above, FIGS. 1-2 illustrate a conventional 7-inch "Ames style" flat box device 20. FIGS. 3-12 and 14-23 show a first illustrative embodiment of the present invention. The first illustrative embodiment described herein is designed and adapted to work with the conventional 7-inch "Ames style" flat box device 20 shown in FIGS. 1 and 2, as one example application. Other embodiments of the present invention (not shown) may be designed and adapted to work with other existing flat box devices and/or future developed flat box devices, without departing from the scope and spirit of the present invention as defined by the claims.

Figure 3:
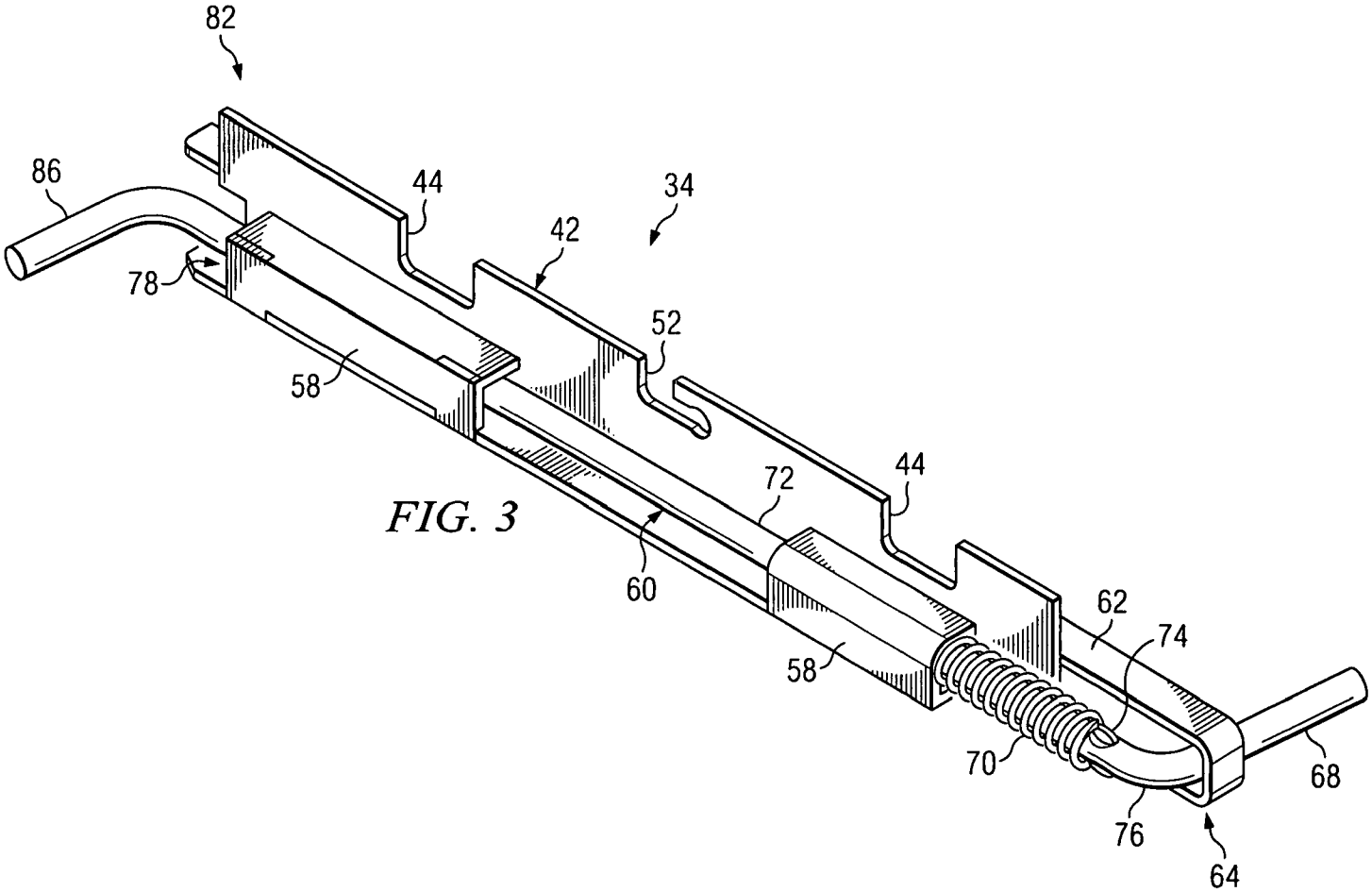
FIGS. 3 and 4 show two different perspective views of a guide device in accordance with a first illustrative embodiment of the present invention.
Figure 4:
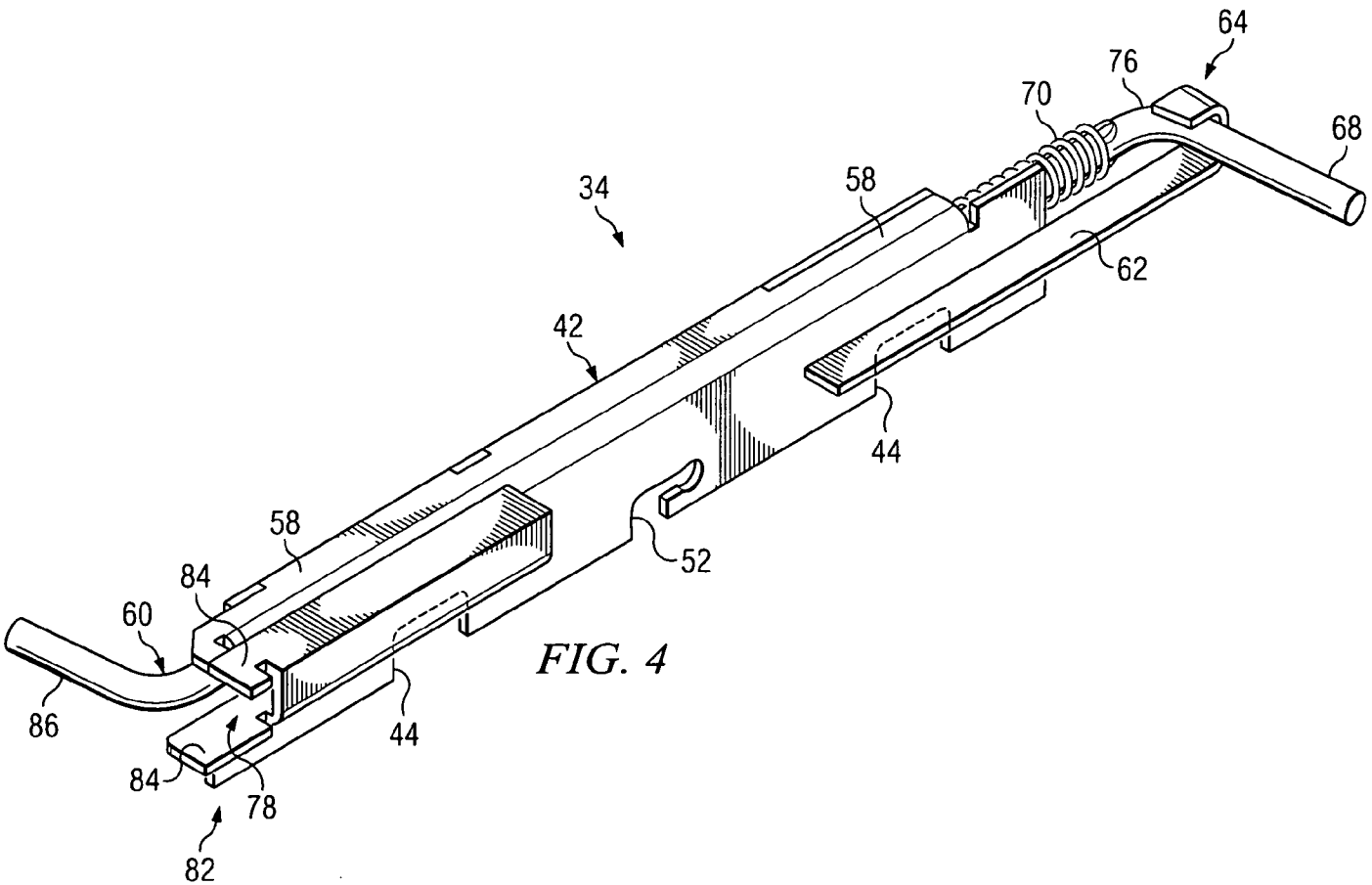
Figure 5:
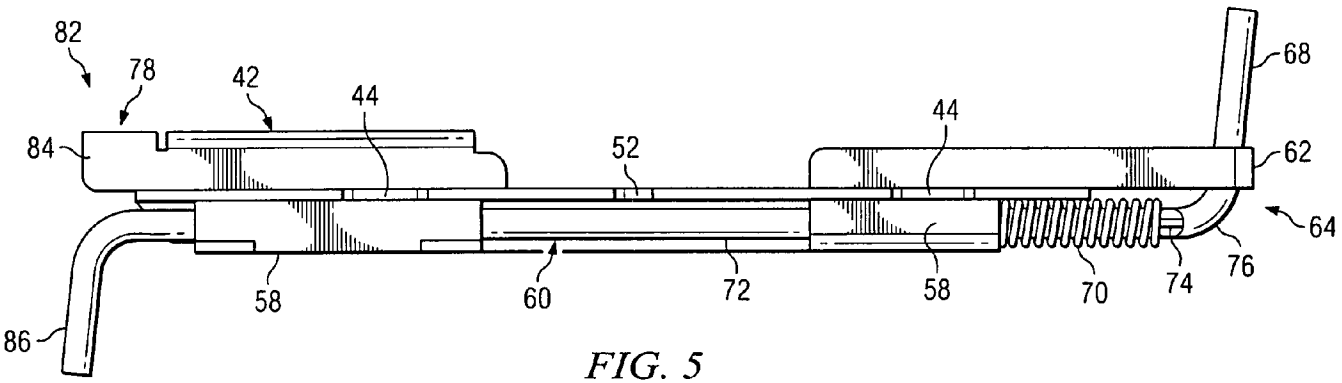
FIG. 5 is a back view of the guide device of the first embodiment.
Figure 6:
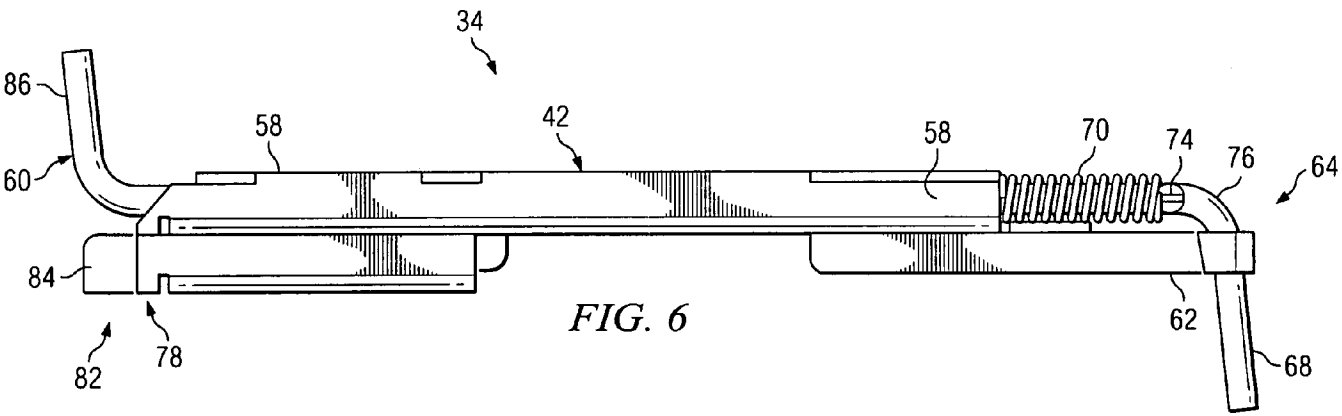
FIG. 6 is a front view of the guide device of the first embodiment.
Figure 7:
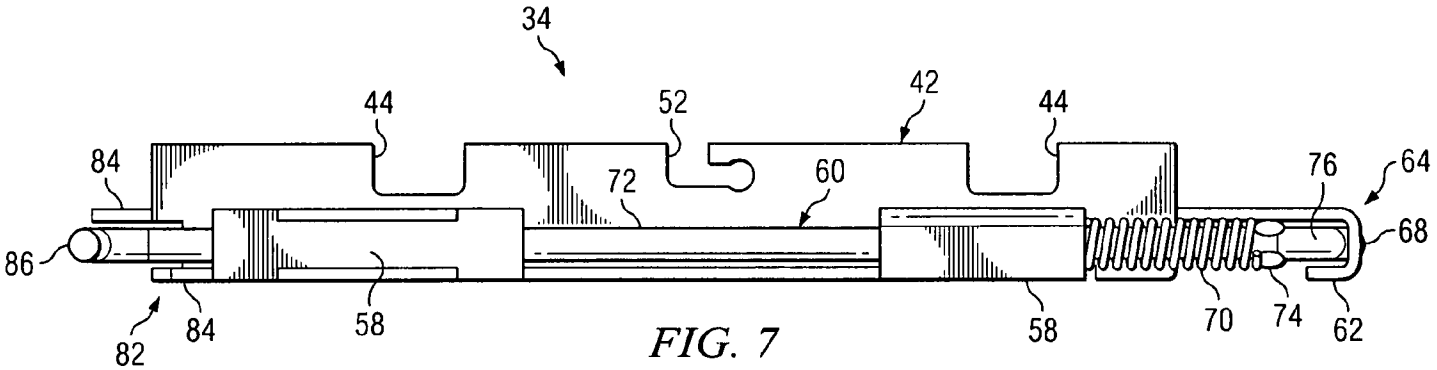
FIG. 7 is a top view of the guide device of the first embodiment.
Figure 8:
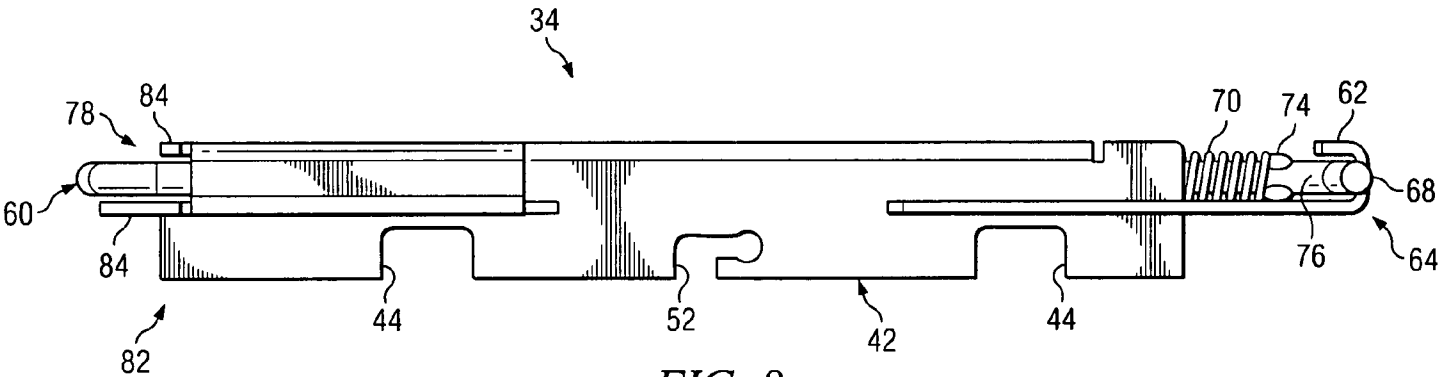
FIG. 8 is a bottom view of the guide device of the first embodiment.
Figure 9:
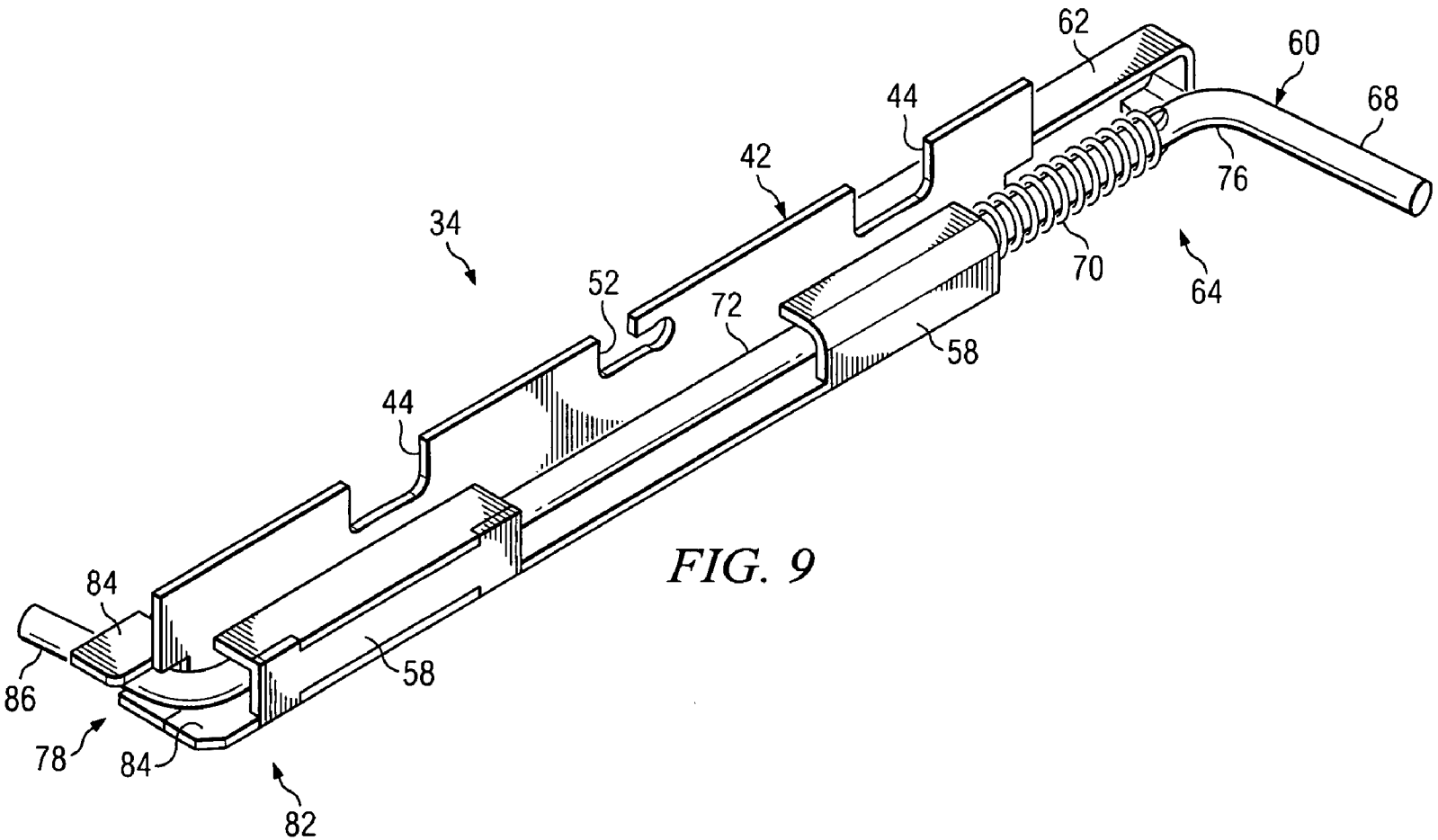
FIG. 9 is another perspective view of the guide device of the first embodiment.
Figure 10:
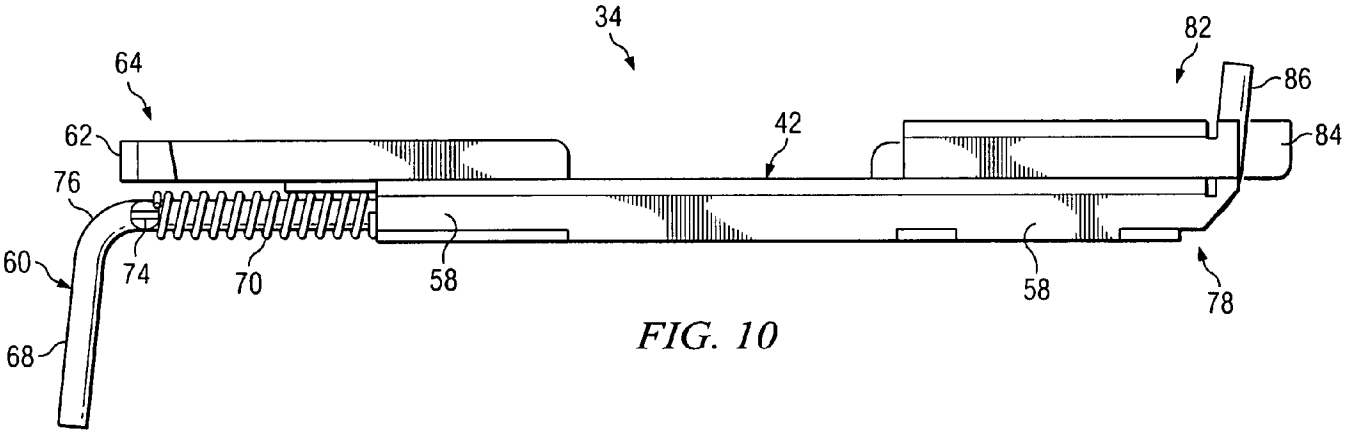
FIG. 10 is another front view of the guide device of the first embodiment.
Figure 11:
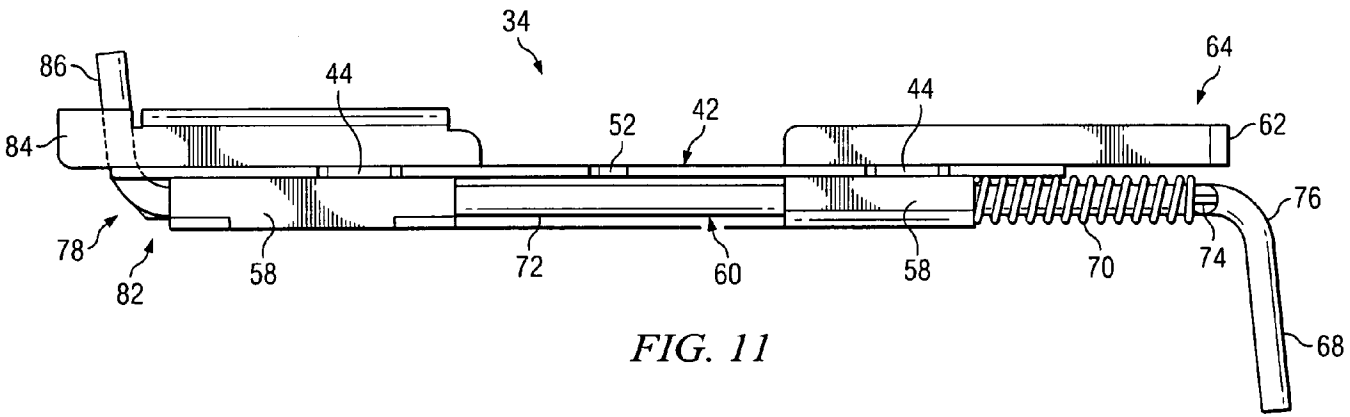
FIG. 11 is another back view of the guide device of the first embodiment.

First, a general overview of the figures is provided. And then, the figures will be described in more detail. FIGS. 3-11 show various views of a guide device 34 of the first illustrative embodiment of the present invention. FIGS. 3 and 4 show two different perspective views of the guide device 34. FIG. 5 is a back view of the guide device 34. FIG. 6 is a front view of the guide device 34. FIG. 7 is a top view of the guide device 34. FIG. 8 is a bottom view of the guide device 34. FIG. 9 is another perspective view of the guide device 34. FIG. 10 is another front view of the guide device 34. FIG. 11 is another back view of the guide device 34.

Figure 2:
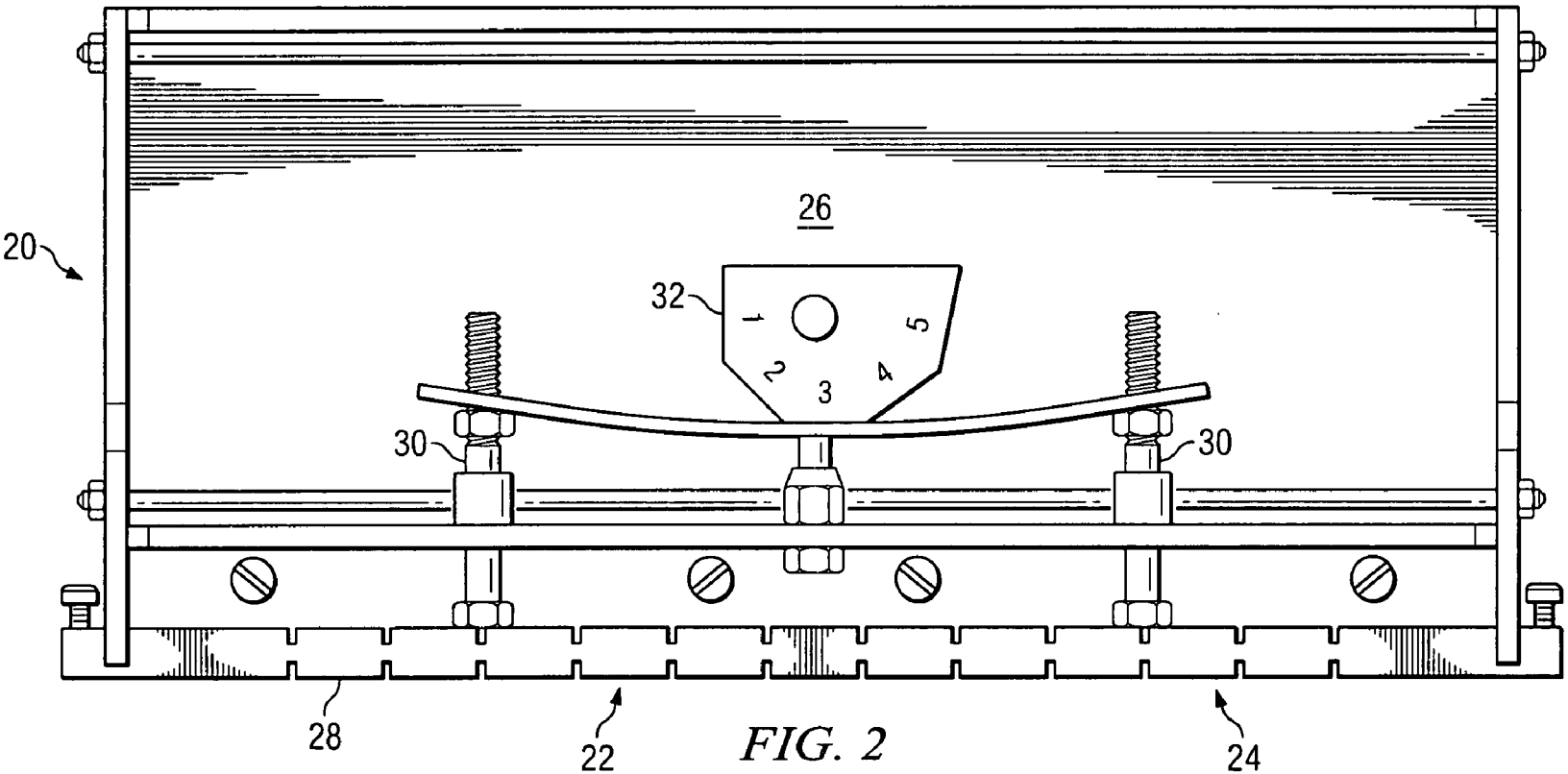
FIG. 2 (PRIOR ART)
FIG. 2 is a front view of the flat box device of FIG. 1.
Figure 12:
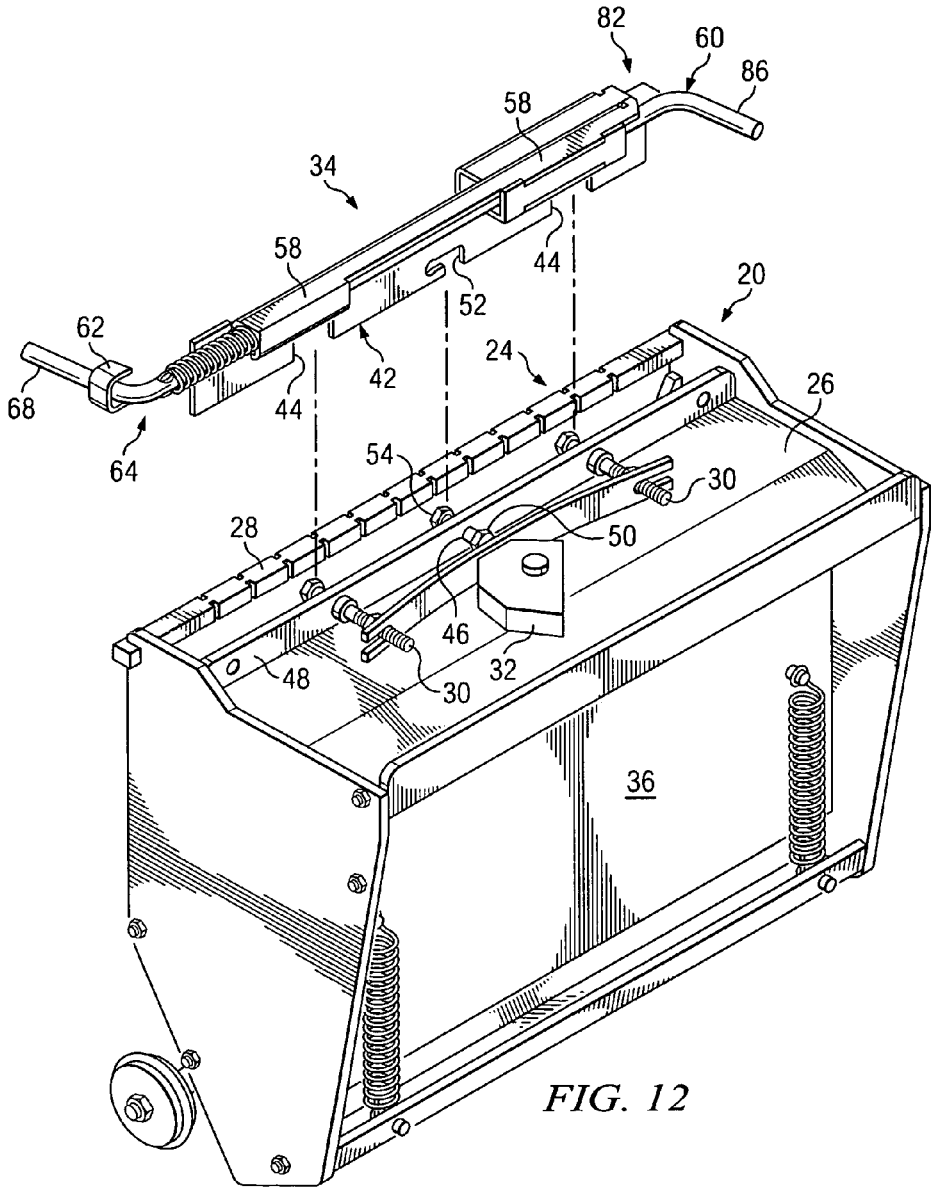
FIG. 12 shows the guide device of the first embodiment next to the flat box device of FIGS. 1 and 2.

The guide device 34 is adapted to be removably attached to a flat box device (such as the flat box device 20 shown in FIGS. 1 and 2). FIG. 12 shows the guide device 34 of the first embodiment next to the flat box device 20 of FIGS. 1 and 2. As is preferred, the length of the guide device 34 corresponds to the width of the flat box device 20 that it is designed to work with. Flat box devices come in different sizes (e.g., 7-inch wide, 10-inch wide, etc.).

Figure 13:
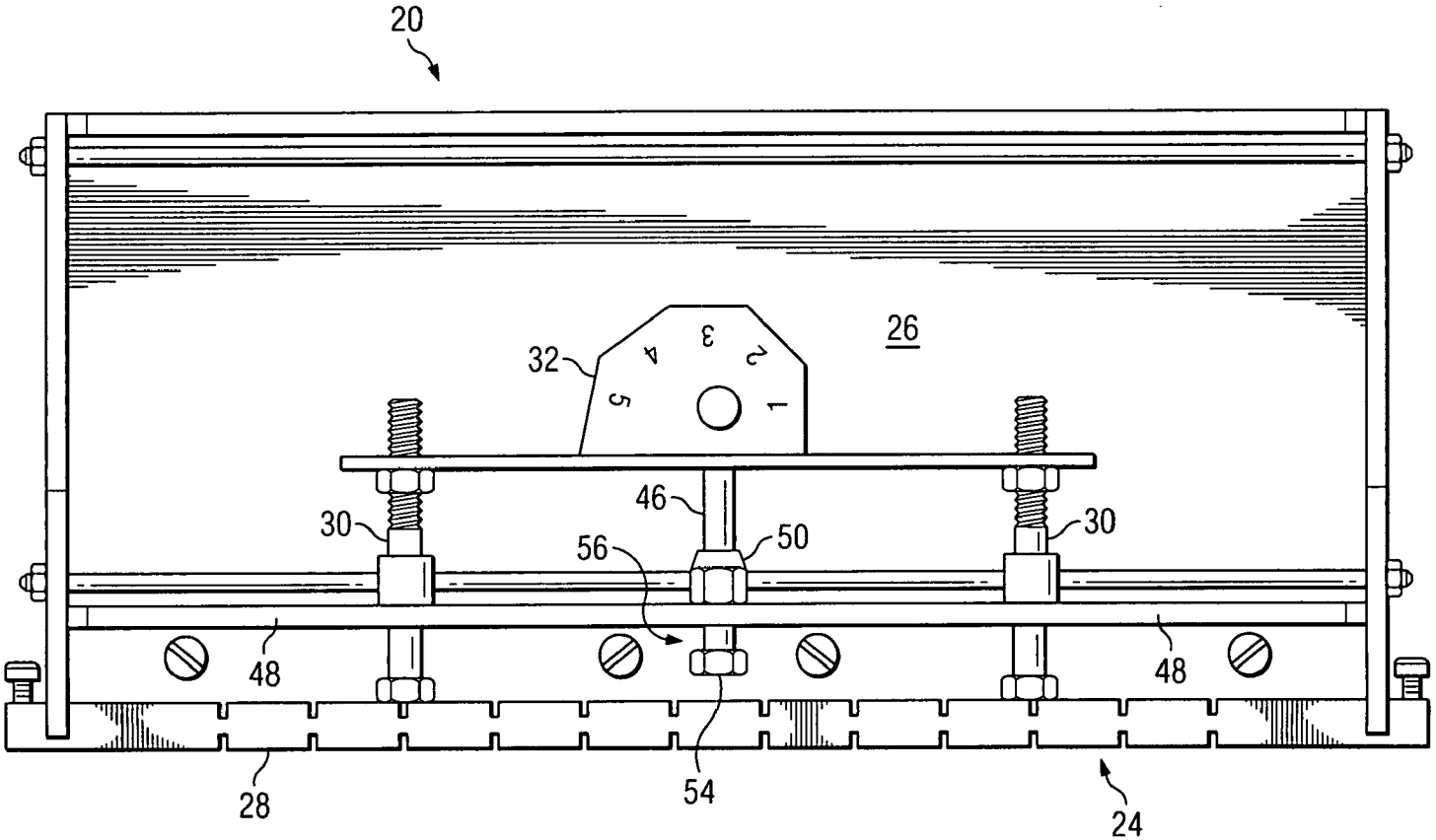
FIG. 13 (PRIOR ART)
FIG. 13 shows the flat box device of FIGS. 1 and 2 with the pressure selection cam set to the zero position.
Figure 14:
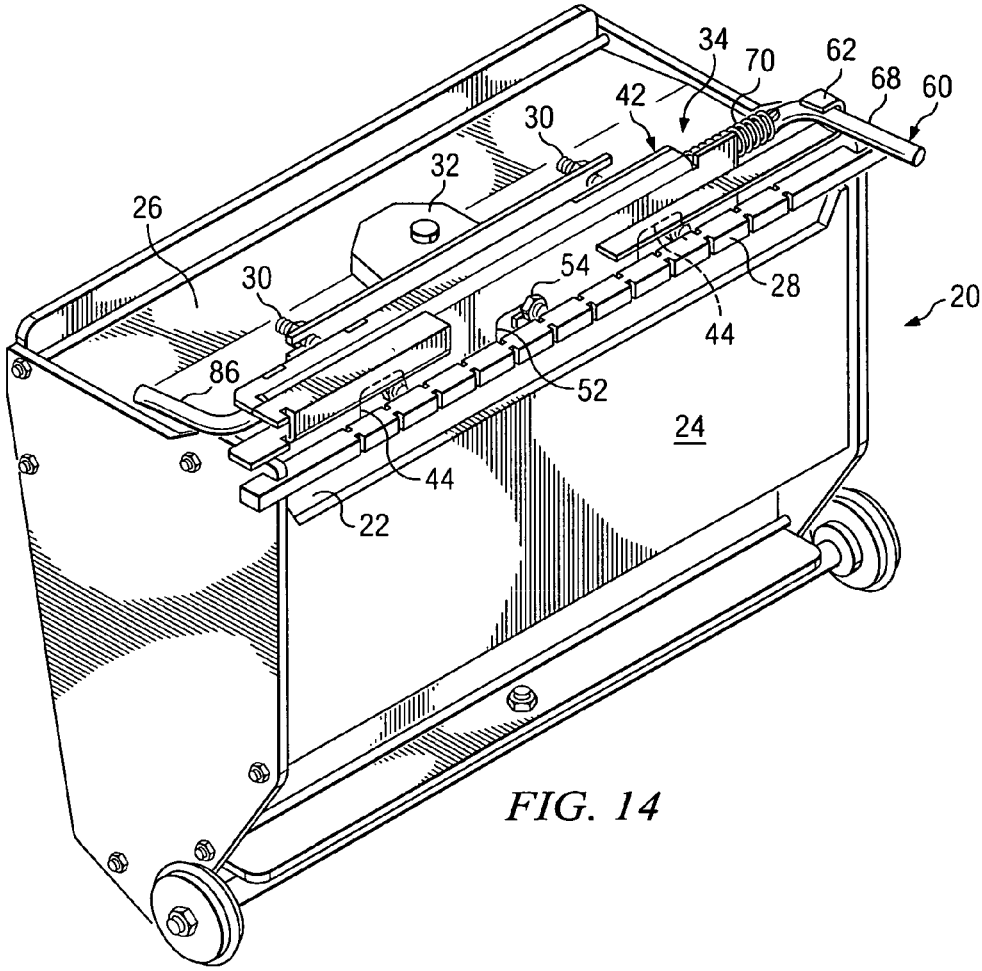
FIGS. 14-18 show various views of the guide device operably installed on the front side of the flat box device.
Figure 15:
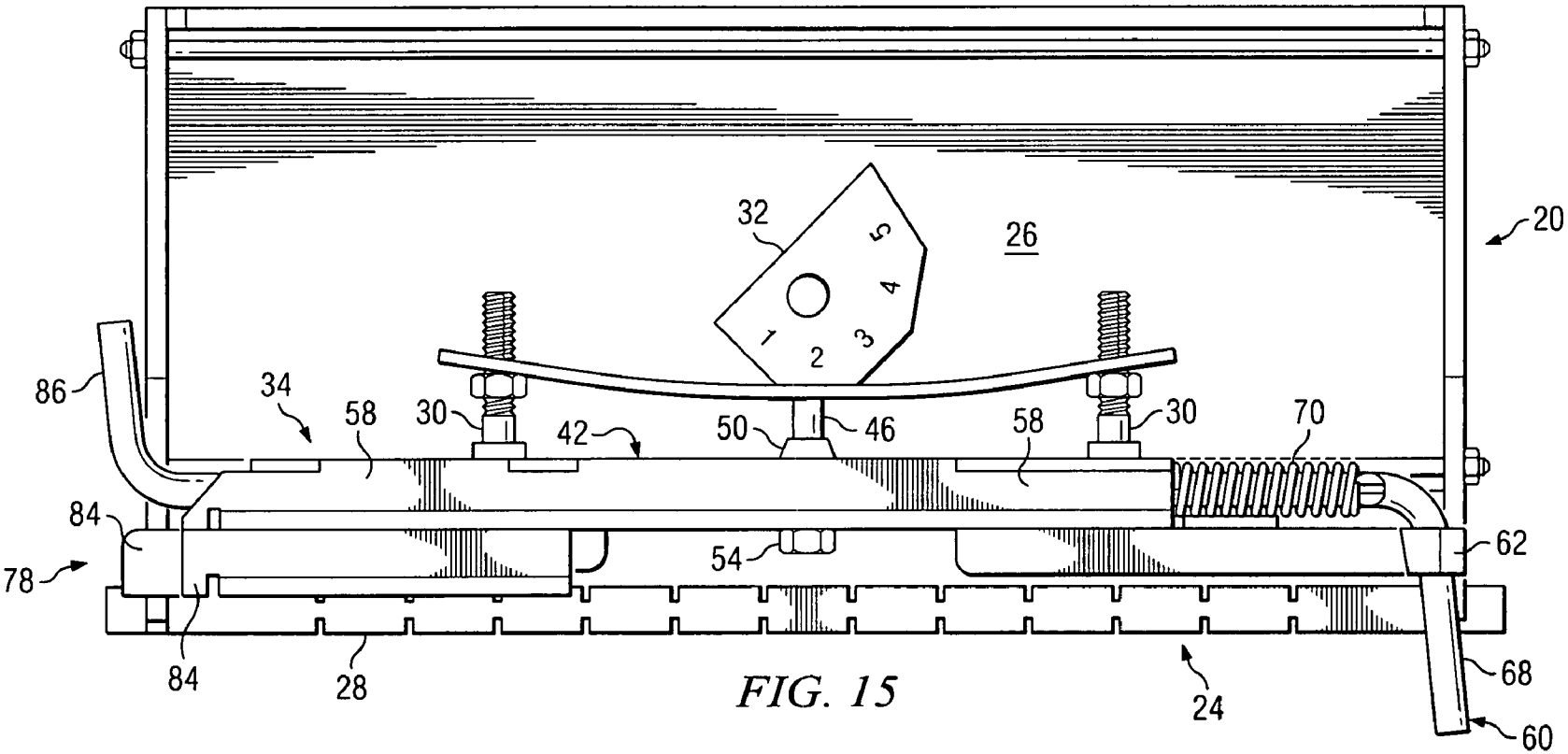
Figure 16:
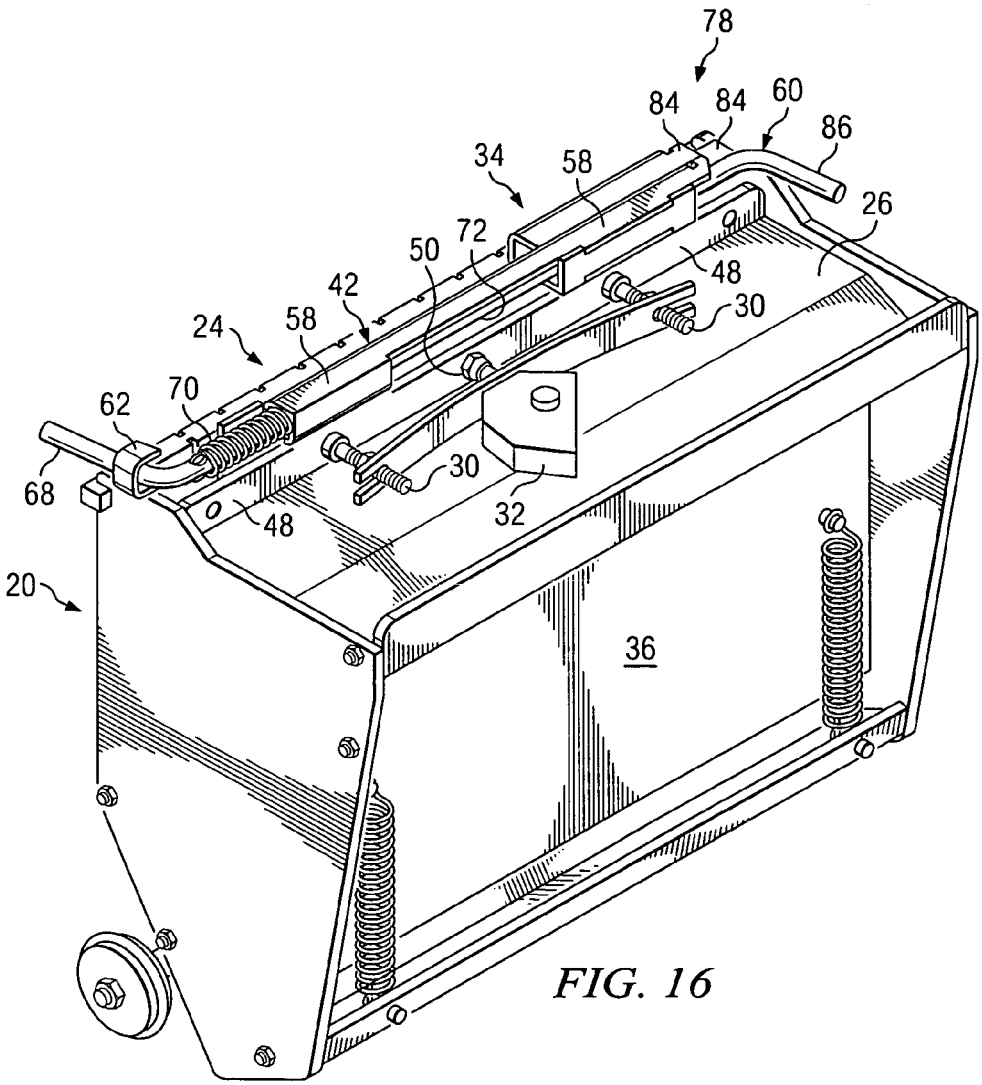
Figure 17:
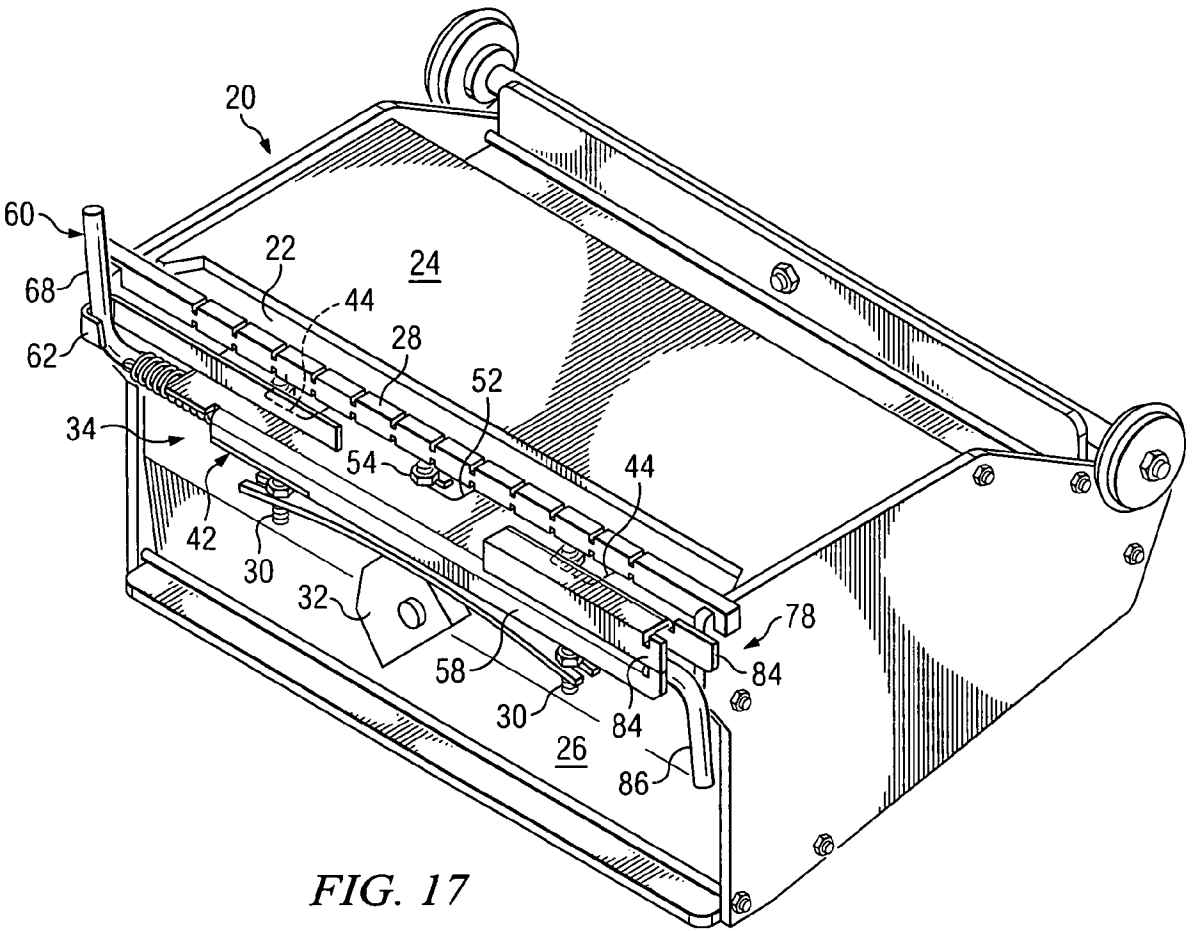
Figure 18:
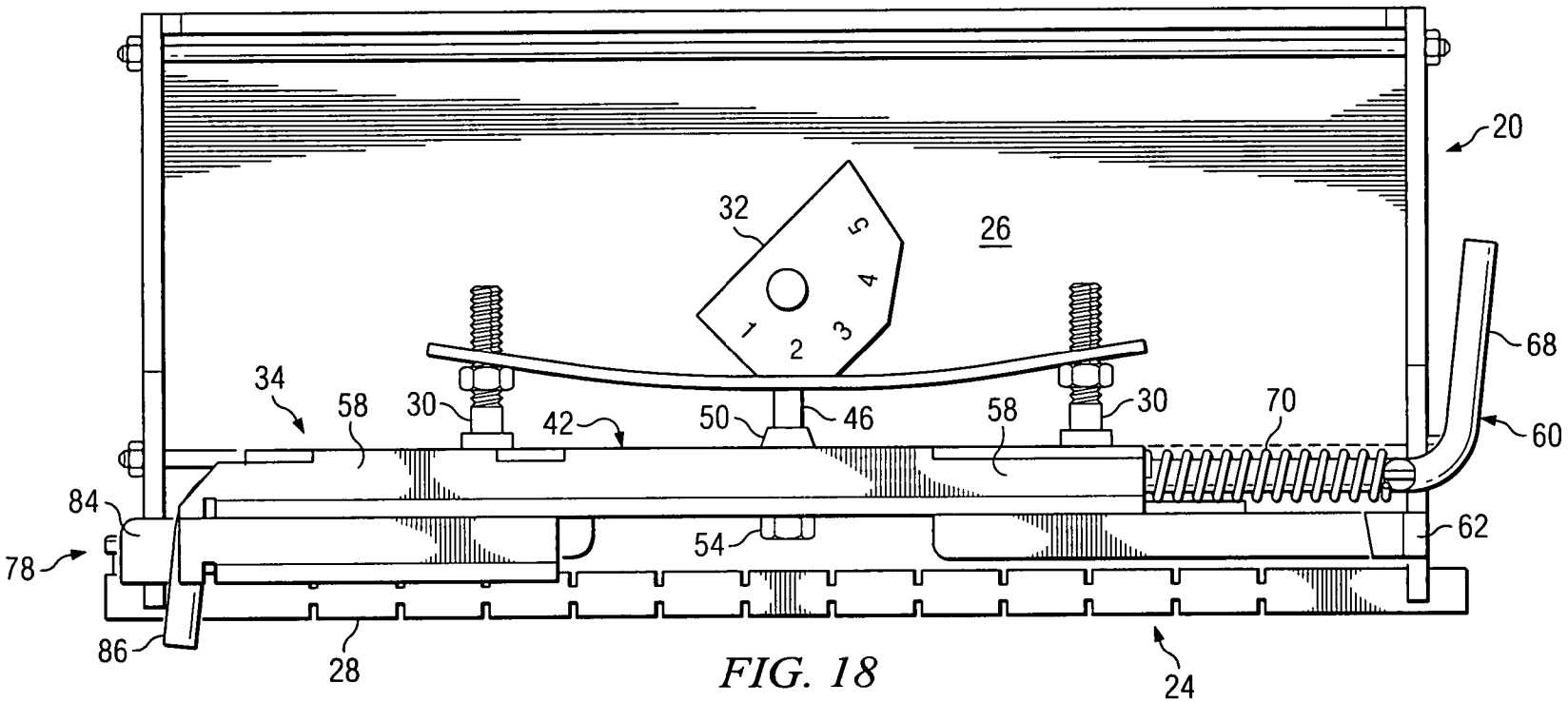

FIG. 13 shows the flat box device 20 with the pressure selection cam 32 set to the zero position to minimize the spring bias against the adjustment screws 30. FIGS. 14-18 show various views of the guide device 34 operably installed (removably attached) on the front side 26 of the flat box device 20. More specifically, FIG. 14 is a bottom perspective view showing the bottom and front sides 24, 26 of the flat box device 20 with the guide device 34 operably installed on the front side 26 of the flat box device 20. FIG. 15 is a front view of the flat box device 20 showing the guide device 34 operably installed on the front side 26 of the flat box device 20. FIG. 16 is a top perspective view showing the top side 36 and the front side 26 of the flat box device 20 with the guide device 34 operably installed on the front side 26 of the flat box device 20. FIG. 17 is another bottom perspective view showing the bottom and front sides 24, 26 of the flat box device 20 with the guide device 34 operably installed on the front side 26 of the flat box device 20. FIG. 18 is another front view of the flat box device 20 showing the guide device 34 operably installed on the front side 26 of the flat box device 20.

Figure 19:
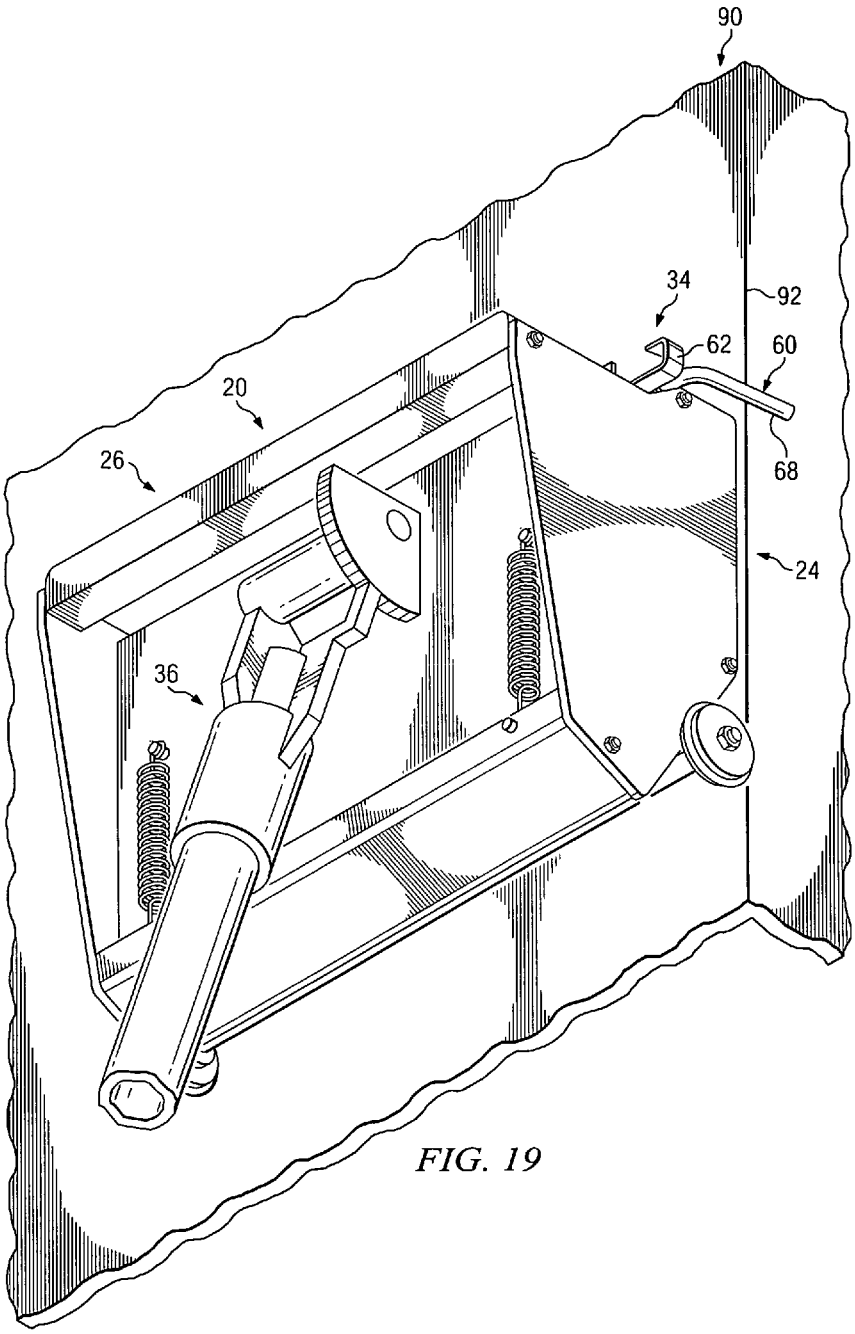
FIG. 19 shows the flat box device being used to apply drywall mastic at an outside corner while using the guide device of the first embodiment to guide the flat box device along the edge.
Figure 20:
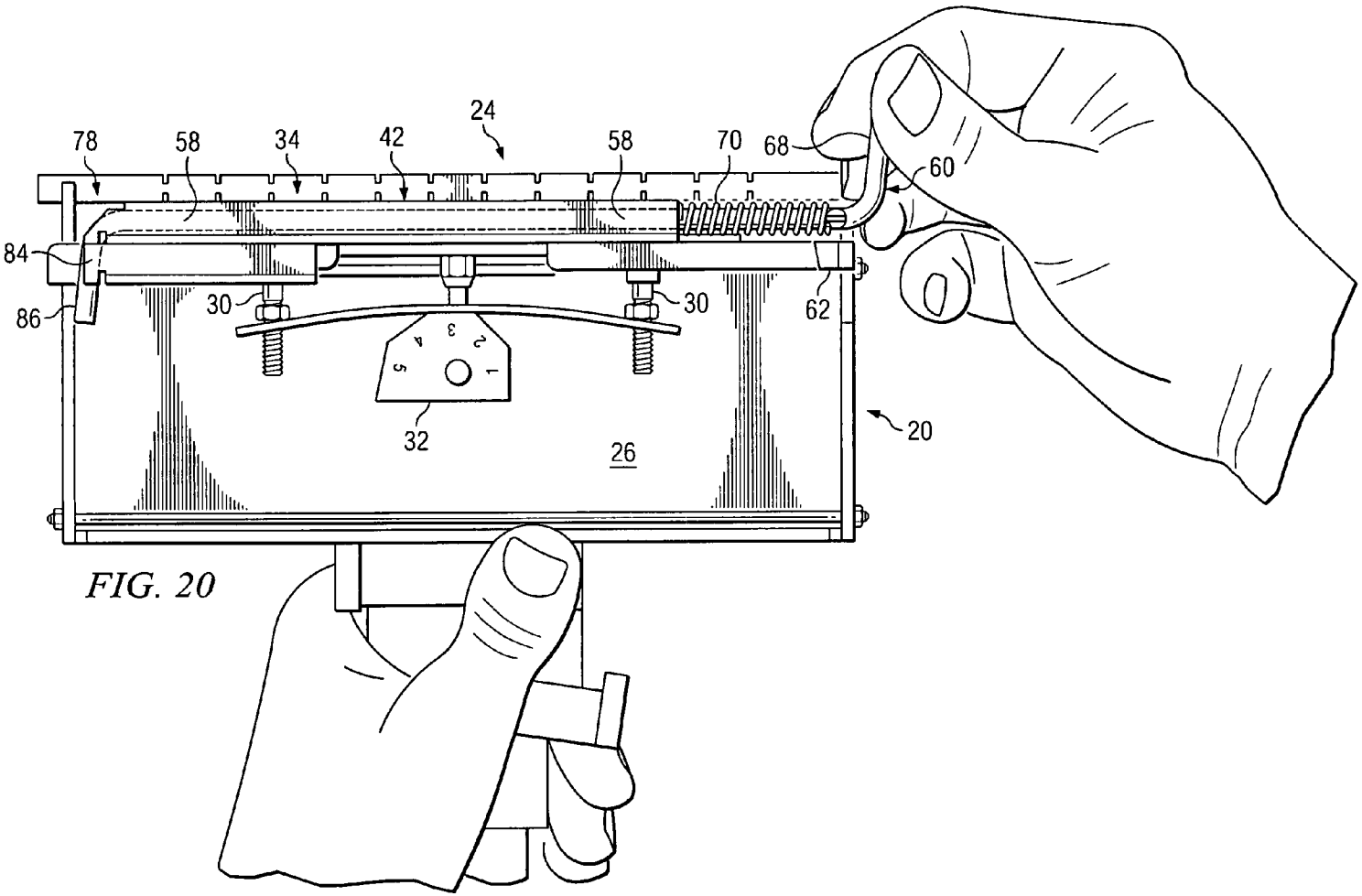
FIGS. 20-22 show a person switching the guide device from one configuration (for guiding on the right side) to another configuration (for guiding on the left side)
Figure 21:
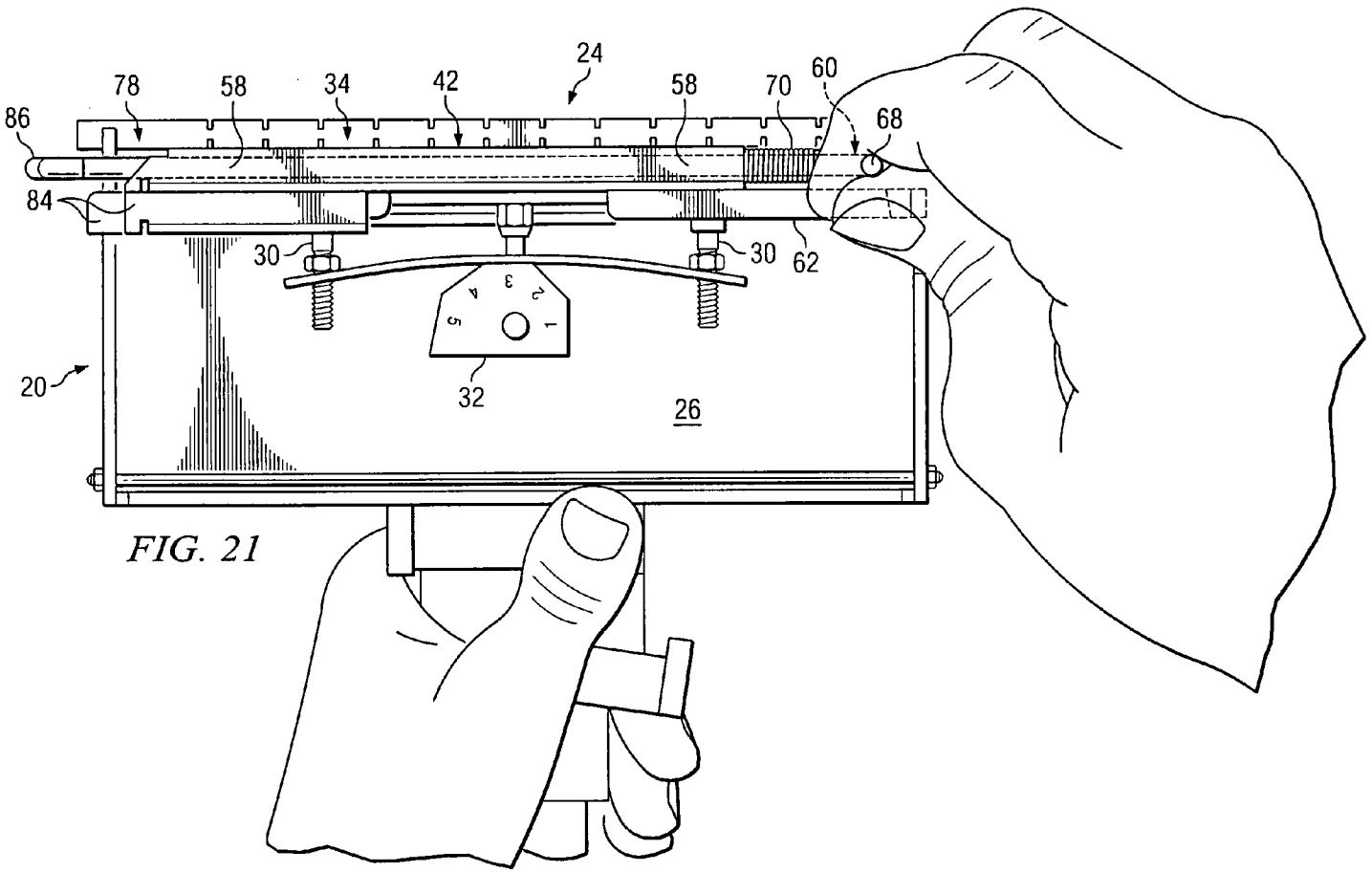
Figure 22:
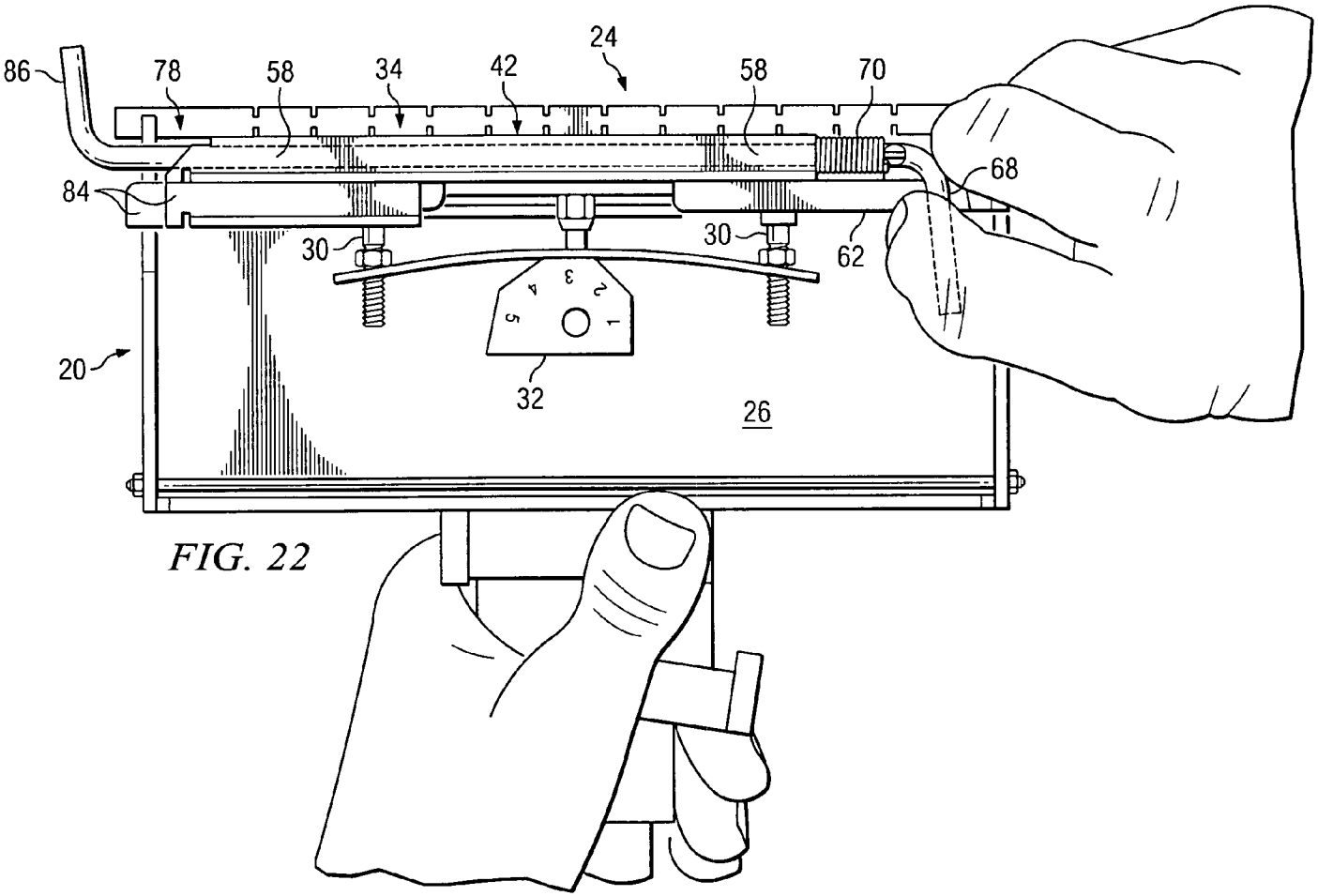
Figure 23A:
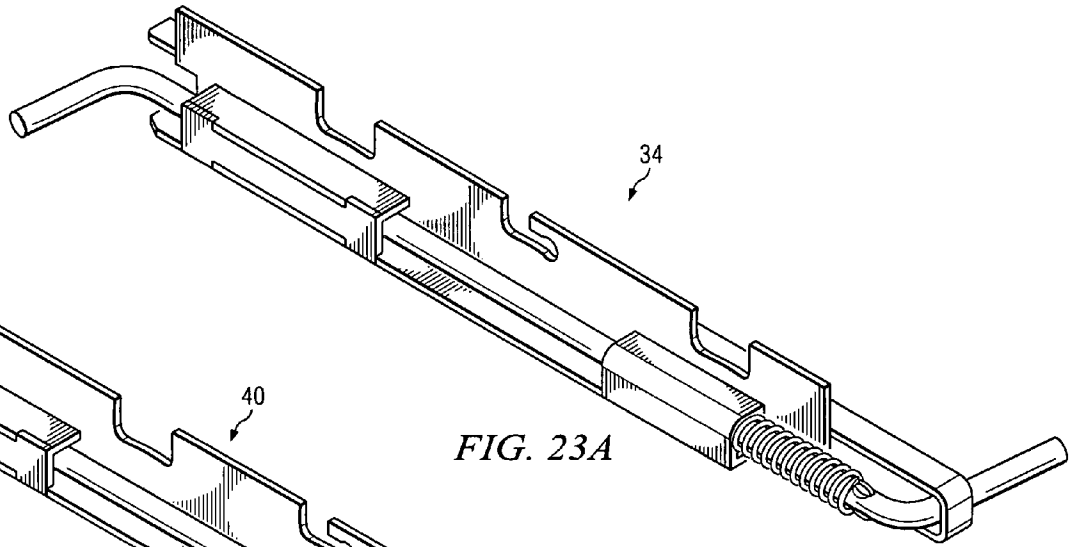
FIG. 23 shows a 7-inch guide device and a 10-inch guide device, both in accordance with the first embodiment of the present invention.
Figure 23B:
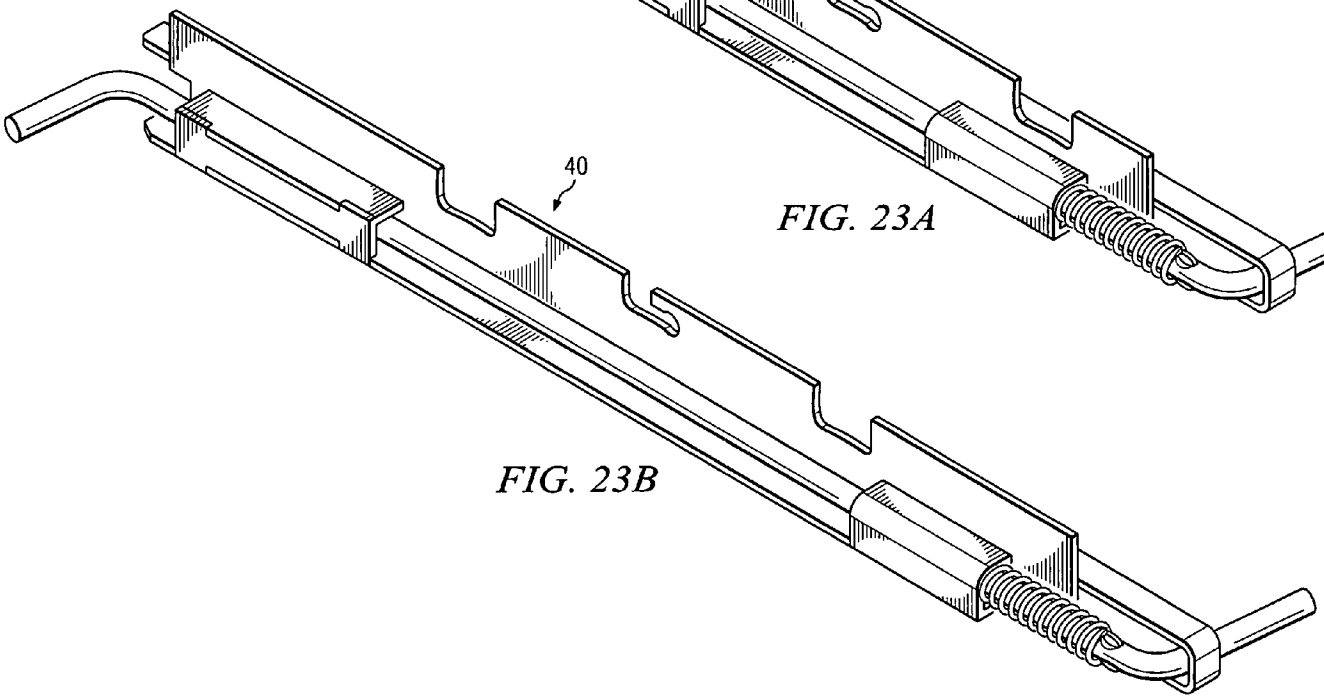

FIG. 19 shows the flat box device 20 being used to apply drywall mastic at an outside corner 38 while using the guide device 34 of the first embodiment to guide the flat box device 20 along the edge. FIGS. 20-22 show a person switching the guide device 34 from one configuration (for guiding on the right side) to another configuration (for guiding on the left side). FIG. 23 shows a 7-inch guide device 34 and a 10-inch guide device 40 (for 10-inch flat box devices), both in accordance with the design of the first embodiment of the present invention.

When operably installed on a flat box device 20, the guide device 34 provides two guide configurations, one for providing a guide on the left side (e.g., for outside corners with edge on left side of flat box device 20) and another for providing a guide on the right side (e.g., for outside corners with edge on right side of flat box device 20) (see e.g., FIG. 19). Also, the guide device 34 of the first embodiment may be operably installed on the flat box device 20 two ways (one way flipped relative to the other). While describing the figures, the configuration and orientation of guide device 34 will be noted as well. Hence, the figures illustrate different possible configurations and attachment orientations of the first illustrative embodiment of the present invention.

Referring now to FIGS. 3-7, 13, and 15, the guide device 34 and its components will be described in more detail. In FIGS. 3-7, the guide device 34 is shown in a first guide configuration. The guide device 34 of the first embodiment includes a bracket portion 42. The bracket portion 42 has two adjustment screw notches 44 to provide clearance for the adjustment screws 30 on the flat box device 20 (see e.g., FIG. 13). Referring briefly to FIG. 13, a central cam adjustment screw 46 attaches the pressure selection cam 32 to the frame 48 of the flat box device 20. As shown in FIG. 13, a central adjustment nut 50 is threaded on the central cam adjustment screw 46. And in FIG. 13, the central adjustment nut 50 is loosened to allow for attachment of the guide device 34. With the central adjustment nut 50 loosened and with the pressure selection cam 32 set to the zero position, as shown in FIG. 13, the guide device 34 can be easily positioned into place on the flat box device 20 so that it is operably installed (see e.g., FIG. 15). Referring again to FIGS. 3-7, the bracket portion 42 also has a central slot 52, which is generally L-shaped in the first illustrative embodiment. The central slot 52 is designed to fit on the central cam adjustment screw 46 (see FIG. 13) between the frame 48 of the flat box device 20 and an end nut 54, where the end nut 54 is located at the end of the central cam adjustment screw 46. When the central adjustment nut 50 is loosed and with the pressure selection cam 32 set to the zero position, as shown in FIG. 13, a gap 56 is formed between the end nut 54 and the frame 48 of the flat box device 20. This gap 56 is where the bracket portion 42 of the guide device 34 fits onto flat box device 20 for operably installing the guide device 34 onto the flat box device 20. After the guide device 34 is inserted into the gap 56, the guide device 34 can be slid laterally so that the central cam adjustment screw 46 slides into the central slot 52. Because the two adjustment screw notches 44 are elongated, the guide device 34 is permitted to slid laterally as the central cam adjustment screw 46 slides into the central slot 52 laterally. Next, the central adjustment nut 50 may be tightened (e.g., finger tight, or tighter with a wrench). At that point the guide device 34 is operably installed, as shown in FIG. 15.

An advantage of the guide device 34 of the first embodiment is that the pressure selection cam 32 is still operable when the guide device 34 is operably installed on the flat box device 20. As shown in FIG. 15, the pressure selection cam 32 is set to position 2 to apply pressure to the application blade 28. The adjustment screws 30 are not hindered by the adjustment screw notches 44 in the bracket portion 42 of the guide device 34, and are permitted to be urged toward the application blade 28 in response to the selected position on the pressure selection cam 32.

Another advantage of the first embodiment of the present invention is that the guide device 34 can be installed and removed on the existing Ames style flat box device 20 without permanently altering the flat box device 20. This is a key advantage because most flat box devices are not sold outright, but rather are only rented. Thus, a guide device 34 of the first embodiment can be operably installed and used with a rented flat box device, and then later removed, without permanently altering and damaging the rented flat box device. This will allow a guide device 34 in accordance with a first embodiment of the present invention to be used with the large number of existing flat box devices available for rental and use by construction professionals throughout the industry.

Referring again to FIGS. 3-7, the bracket portion 42 of the first embodiment guide device 34 further includes two slider sleeves 58 for retaining a guide bar member 60. The two slider sleeves 58 allow the guide bar member 60 to slide laterally and to pivot and rotate within the slider sleeves 58. In other embodiments (not shown), there may be any number of slider sleeves 58 (e.g., 0, 1, 2, 3, etc.). In the first embodiment, and as is currently preferred, the bracket portion 42 of the guide device 34 is formed from several pieces of sheet metal, which have been stamp cut, bent, and welded together to form the bracket portion 42.

In the first embodiment, the bracket portion 42 is made from stainless steel to prevent rusting and provide durability during repeated use. However, in other embodiments of the present invention, the bracket portion 42 of the guide device 34 may be made from any suitable material(s), including (but not necessarily limited to): metal, steel, brass, tin, nickel, zinc, magnesium, aluminum, titanium, natural fiber, synthetic fiber, fiberglass, nylon, plastic, wood, composites thereof, compounds thereof, alloys thereof, and any combination thereof, for example. The bracket portion 42 of the guide device 34 may be formed using any suitable manufacturing process(es) for the selected material(s), including (but not necessarily limited to): stamp cutting, pressing, bending, welding, bonding, adhesive, molding, machining, curing, anodizing, chemical etching, cutting, sawing, and any combination thereof, for example.

Still referring to FIGS. 3-7, the bracket portion 42 of the first embodiment further includes a hook-shaped portion 62 extending at a first end 64 of the guide device 34. As shown in FIGS. 3-7, this hook-shaped portion 62 is used to retain a first guide bar end 68 of the guide bar member 60 when the guide device 34 is in the first guide configuration.

A spring 70 biases the first guide bar end 68 away from a first slider sleeve portion 58 of the bracket portion 42. And when in the first guide configuration, as shown in FIGS. 3-7, the spring 70 biases the first guide bar end 68 toward and into the hook-shaped portion 62 to retain the first guide configuration during use of the guide device 34. As shown in FIG. 15, the spring 70 is configured to provide spring bias along the lateral direction of the flat box device 20 when the guide device 34 is operably installed on the flat box device 20. In the first embodiment, the spring 70 is a coil spring that is coiled about a central portion 72 of the guide bar member 60. And in the first embodiment, as is currently preferred, the spring 70 is made from stainless steel to prevent rust during repeated use. In other embodiments (not shown), the spring 70 may be made from any suitable spring material, including (but not necessarily limited to): metal, steel, titanium, elastic material, urethane, polymer, rubber, fiberglass, nylon, composite material, composites thereof, compounds thereof, alloys thereof, and combinations thereof, for example. Also in other embodiments (not shown), the spring 70 may be any of any suitable type and configuration to provide a lateral bias (or otherwise) to retain the guide device 34 in a first and/or second guide configuration, including (but not necessarily limited to) to the following types: coil, leaf, cantilever, elastic band, compressible elastic material, expandable elastic material, spiral, torsion, and combinations thereof, for example. Also in other embodiments (not shown), there may be any number of spring members (same or different) used to retain the guide device 34 in a first and/or second guide configuration.

In the first illustrative embodiment, a spring stop portion 74 extends from the guide bar member 60 along the central portion 72 of the guide bar member 60 adjacent a first bend 76 for the first guide bar end 68. In this example, the spring stop portion 74 is formed by crimping the guide bar member 60 so that portions of the guide bar member 60 extend radially outward. In other embodiments (not shown), the spring stop portion 74 may be formed in other ways, such as (but not limited to): wielding a washer or nut onto the guide bar member, wielding the end of the spring to the guide bar member, allowing the first bend to act as the spring stop, placing a ring within a circumvential groove formed in the guide bar member, threading a set screw into the guide bar member, or any combination thereof, for example.

Still referring to FIGS. 3-7, the guide bar member 60 of the first illustrative embodiment is made from stainless steel with a solid round cross-section and with a generally S-shaped layout. Or as another way to describe it, the guide bar member 60 has two oppositely extending generally L-shaped portions. In other embodiments (not shown), the guide bar member 60 may be made from any suitable material, including (but not necessarily limited to): metal, aluminum, brass, steel, titanium, polymer, composite material, composites thereof, compounds thereof, alloys thereof, and combinations thereof, for example. Also, in other embodiments, the cross-section shape of the guide bar member 60 may having any suitable cross-section shape and structure, including (but not necessarily limited to): solid, hollow, round, elliptical, oval, square, rectangular, triangular, pentagonal, hexagonal, octagonal, or multi-material structure (e.g., having a different material core than the outer core), for example. Although the guide bar member 60 of the first embodiment is one piece that extends from one side to another, other embodiments (not shown) may have multiple guide bar members that each extend on only one side, for example.

Still referring to FIGS. 3-7, the bracket portion 42 of the first embodiment also includes a channel portion 78 at a second end 82 of the guide device 34. This channel portion 78 is formed by flanges 84 of the bracket portion 42 extending from the second end 82 of the guide device 34. The channel portion 78 of the bracket portion 42 is used to retain a second guide bar end 86 of the guide bar member 60 when the guide device 34 is in the second guide configuration. This second guide configuration for the first embodiment is shown in FIGS. 9-11. Similar to the way that the hook-shaped portion 62 at the first end 64 of the guide device 34 retains the first guide bar end 68 for the first guide configuration (see e.g., FIGS. 3-7), the channel portion 78 at the second end 82 of the guide device 34 retains the second guide bar end 86 for the second guide configuration (see e.g., FIGS. 9-11). In the first guide configuration (see e.g., FIGS. 3-7), the hook-shaped portion 62 prevents the first guide bar end 68 from pivoting beyond a certain range (e.g., less than about 15 degrees) of pivotal movement. Likewise, the flanges 84 of the channel portion 78 retain the position of the second guide bar end 86 and prevent the second guide bar end 86 from pivoting beyond a certain range (e.g., less than about 25 degrees) of pivotal movement. Yet, there are some differences. In the first guide configuration, the spring 70 laterally urges the first guide bar end 68 away from the bracket portion 42 and into the hook-shaped portion 62. In the second guide configuration, the spring 70 laterally urges the guide bar member 60 in the same direction as in the first guide configuration. Hence in the second guide configuration, the spring 70 laterally urges the second guide bar end 86 toward the bracket portion 42 and into the channel portion 78 at the second end 82.

FIGS. 14-17 show the guide device 34 operably installed on the flat box device 20 with the hook-shaped portion 62 and the first guide bar end 68 on the left side of the flat box device 20, and with the guide bar member 60 in the first guide configuration (as in FIGS. 3-7). In this case, the first guide bar end 68 provides a guide for the left side (e.g., for an outside corner edge being on the left side of the flat box device 20) when the guide bar member 60 is in the first guide configuration.

FIG. 18 again shows the guide device 34 operably installed on the flat box device 20 with the hook-shaped portion 62 and the first guide bar end 68 on the left side of the flat box device 20. But in FIG. 18, the guide bar member 60 is in the second guide configuration (as in FIGS. 9-11). In this case, the second guide bar end 86 provides a guide for the right side (e.g., for an outside corner edge being on the right side of the flat box device 20) when the guide bar member 60 is in the second guide configuration.

FIG. 19 shows the guide device 34 of the first embodiment being used on the flat box device 20 to guide the flat box device 20 along an outside corner 90 with its edge 92 on the right side of the flat box device 20. To use the flat box device 20 with the guide device 34, the user sets the guide bar member 60 to the first or second guide bar configuration needed to make the first or second guide bar end (68 or 86) extend below the bottom side 24 of the flat box device 20 on the side that the outside corner 90 or edge 92 will be in relation to the flat box device 20. Hence, as shown in FIG. 19, the first guide bar end 68 extends below the bottom side 24 of the flat box device 20 on the right side of the flat box device 20 to guide the flat box device 20 along an outside corner 90 having its edge 92 on the right side of the flat box device 20.

With the guide bar member 60 in its appropriate configuration for the corner 90 being worked on, the user simply uses the flat box device 20 as usual, except that the guide bar end (68 or 86) rides along the edge of the corner 90. The user can gently pull the flat box device 20 in a direction so that the guide bar end (68 or 86) maintains a gentle pressure against the edge 92 of the corner 90 while pulling on the flat box device 20. The guide device 34 keeps the flat box device 20 at a consistent location relative to the edge 92 as the flat box device 20 travels parallel with the edge 92.

An advantage of using the flat box device with a guide device of the present invention is that the user can move the flat box quickly along the edge while also maintaining a consistent location relative to the edge. This can greatly speed up the process of using a flat box device along an outside corner. Another advantage of using a guide device of the present invention is that a precise and high quality application of mastic may be achieved along an edge without requiring special skills or abilities of the user beyond knowing how to use a flat box device. Still another advantage of a guide device for an embodiment of the present invention may be the ability to operably install the guide device onto and remove the guide device from the flat box device quickly and easily. This allows the guide device to be installed and used quickly, with little hassle. And, this allows the guide device to be removed quickly to allow the flat box to be used on flat surfaces (i.e., not along corners). For some embodiments, it is also possible to set the guide device to a configuration where the flat box device can be used on flat surfaces (i.e., not along corners) without a guide bar end (68 or 86) extending below the bottom side 24 of the flat box device 20 and without removing the guide device 34 from the flat box device 20.

In FIG. 19, notice that the guide device 34 is operably installed on the flat box device 20 with the hook-shaped portion 62 and the first guide bar end 68 on the right side of the flat box device 20. As shown in FIGS. 20-22, the guide device 34 of the first embodiment can also be operably installed on a flat box device 20 so that the hook-shaped portion 62 and the first guide bar end 68 are on the right side of the flat box device 20. This is the preferred orientation to operably install the guide device 34 of the first embodiment on the flat box device 20.

Still another advantage of the guide device 34 of the first embodiment is that the guide device 34 can be switched between the first guide configuration (see e.g., FIGS. 3-7) and the second guide configuration (see e.g., FIGS. 9-11) quickly and easily without any tools. This is illustrated in FIGS. 20-22. Beginning with FIG. 20, the guide device 34 is in the second guide configuration (see e.g., FIGS. 9-11). In this case, with the guide device 34 operably installed in this preferred orientation on the flat box device 20, the first guide bar end 68 extends below the bottom side 24 of the flat box device 20 when the guide device 34 is in the second guide configuration (compare with different orientation shown in FIG. 18). In the second guide configuration shown in FIG. 20, the guide device 34 is set for providing a guide on the right side of the flat box device 20 (i.e., where outside corner edge is on right side of flat box device 20).

To change the guide device 34 from the second guide configuration (FIG. 20) to the first guide configuration (FIG. 22), the user pushes the first guide bar end 68 toward the bracket portion 42 laterally, thereby compressing the spring 70, as shown in FIG. 21. This pushes the second guide bar end 86 out of the channel portion 78 and allows the second guide bar end 86 to extend beyond the side of the flat box device 20. The guide bar member 60 can then be pivoted while the spring 70 is compressed (see FIG. 21). To obtain the first guide configuration, the user pivots the guide bar member 60 while compressing the spring 70 until the first guide bar end 68 is aligned with the hook-shaped portion 62. Then the user allows the spring 70 to expand as the first guide bar end 68 is guided into the hook-shaped portion 62 to obtain the first guide configuration (as in FIGS. 3-7), as shown in FIG. 22. Then the user can release the first guide bar end 68 and the expansion of the spring 70 will retain the first guide bar end 68 within the hook-shaped portion 62.

FIG. 23 shows a 7-inch guide device 34 and a 10-inch guide device 40 (for 10-inch flat box devices), both in accordance the design of the first illustrative embodiment of the present invention. This illustrates that the guide device may be made in any suitable size to fit on and work with any size flat box device. The 7-inch and 10-inch flat box devices are commonly-used sizes.

In another embodiment (not shown), a guide device may be a mirror symmetrical image of the guide device 34 of the first embodiment. Also in other embodiments (not shown), a bracket portion may have different shapes and bends to provide the same function of the bracket portion 42 shown in the first illustrative embodiment of FIGS. 3-23.

Although embodiments of the present invention and at least some of its advantages have been described in detail, it should be understood that various changes, substitutions, and alterations can be made herein without departing from the spirit and scope of the invention as defined by the appended claims. Moreover, the scope of the present application is not intended to be limited to the particular embodiments of the process, machine, manufacture, composition of matter, means, methods, and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A guide device adapted to be attached to a flat box device for use in applying drywall mastic with the flat box device, the guide device comprising:

a generally S-shaped guide bar, the guide bar comprising
- a first bend at a first end portion,
- a first guide bar end extending from the first bend at the first end portion,
- a second bend at a second end portion,
- a second guide bar end extending from the second bend at the second end portion, and
- a central portion extending between the first bend and the second bend;

a bracket adapted to be attached to the flat box device,
- wherein the guide bar is pivotably and slidably retained by the bracket, and
- wherein the bracket comprises a first bracket portion extending at least partially about the guide bar along at least part of the central portion of the guide bar; and a spring adapted to bias the first guide bar end away from the first bracket portion of the bracket.

2. The guide device of claim 1, further comprising a spring stop portion extending from the guide bar, wherein the spring biases the first guide bar end via the spring stop portion.

3. The guide device of claim 1, wherein the bracket further comprises a generally hook-shaped portion adapted to retain the first guide bar end when the guide device is in a first guide configuration.

4. The guide device of claim 1, wherein the bracket further comprises a channel portion adapted to retain the second guide bar end when the guide device is in a second guide configuration.

5. The guide device of claim 1, wherein the guide bar comprises stainless steel and wherein at least part of the guide bar has a solid round cross-section.

6. The guide device of claim 1, wherein the bracket comprises stainless steel and wherein at least part of the bracket is formed from sheet metal material.

7. The guide device of claim 1, wherein the spring is a metal coil spring located about the guide bar along at least part of the central portion of the guide bar.

8. The guide device of claim 1, wherein the bracket further comprises two elongated notches and one generally L-shaped slot, wherein the generally L-shaped slot is located between the two elongated notches.

9. The guide device of claim 1, wherein the guide bar extends across a width of the flat box device when the guide device is operably installed on the flat box device.

10. The guide device of claim 9, wherein the spring biases the guide bar in a lateral direction corresponding to a width of the flat box device when the guide device is operably installed on the flat box device.

11. The guide device of claim 1, wherein the guide device is adapted to be removably attached to the flat box device using existing hardware of the flat box device.

12. A guide device adapted to be attached to a flat box device for use in applying drywall mastic with the flat box device, the guide device comprising:

a generally S-shaped guide bar;

a bracket adapted to be removable attached to the flat box device,
- wherein the guide bar is pivotably and slidably retained by the bracket,
- wherein the bracket comprises a first bracket portion extending at least partially about the guide bar along at least part of a central portion of the guide bar; and a spring adapted to bias a first guide bar end of the guide bar away from the first bracket portion of the bracket, wherein the guide bar extends across a width of the flat box device when the guide device is operably installed on the flat box device, and wherein the spring biases the guide bar in a lateral direction corresponding to the width of the flat box device when the guide device is operably installed on the flat box device.

13. The guide device of claim 12, wherein the guide bar comprises:

a first bend at a first end portion, the first guide bar end extending from the first bend at the first end portion;

a second bend at a second end portion;

a second guide bar end extending from the second bend at the second end portion; and the central portion extending between the first bend and the second bend.

14. The guide device of claim 13, wherein the spring is a metal coil spring located about the guide bar along at least part of the central portion of the guide bar.

15. The guide device of claim 13, wherein the bracket further comprises a channel portion adapted to retain the second guide bar end when the guide device is in a second guide configuration.

16. The guide device of claim 12, wherein the bracket further comprises a generally hook-shaped portion adapted to retain the first guide bar end when the guide device is in a first guide configuration.

17. The guide device of claim 12, further comprising a spring stop portion extending from the guide bar, wherein the spring biases the first guide bar end via the spring stop portion.

18. The guide device of claim 12, wherein the bracket further comprises two elongated notches and one generally L-shaped slot, wherein the generally L-shaped slot is located between the two elongated notches, and wherein the guide device is adapted to be removably attached to the flat box device using existing hardware of the flat box device.

19. A guide device for a flat box device, the flat box device being adapted for use in applying drywall mastic to a surface, and the flat box device having an mastic application opening extending along a lateral direction on a bottom side of the flat box device, the guide device comprising:

a guide bar member having a generally L-shaped portion;

a first leg portion of the generally L-shaped portion of the guide bar member, the first leg portion being adapted to extend along the lateral direction of the flat box device when the guide device is operably installed on the flat box device;

a second leg portion of the generally L-shaped portion of the guide bar member, the second leg portion being adapted to extend below the bottom side of the flat box device when the guide device is operably installed on the flat box device;

a bracket, wherein the first leg portion of the guide bar member is pivotably and slidably retained by the bracket; and a spring member providing a spring bias between the guide bar member and the bracket generally along the lateral direction of the flat box device when the guide device is operably installed on the flat box device.

20. The guide device of claim 19, wherein the guide bar member is generally S-shaped.

* * * * *